US008262080B2

(12) United States Patent
Matsumoto et al.

(10) Patent No.: US 8,262,080 B2
(45) Date of Patent: Sep. 11, 2012

(54) SHEET FEEDING APPARATUS AND IMAGE FORMING APPARATUS

(75) Inventors: Yuzo Matsumoto, Abiko (JP); Tetsuro Fukusaka, Abiko (JP); Yoshitaka Yamazaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 12/986,402

(22) Filed: Jan. 7, 2011

(65) Prior Publication Data

US 2011/0169211 A1 Jul. 14, 2011

(30) Foreign Application Priority Data

Jan. 13, 2010 (JP) ..... 2010-004886

(51) Int. Cl.
*B65H 3/14* (2006.01)

(52) U.S. Cl. ..... 271/98; 271/97

(58) Field of Classification Search ..... 271/98, 271/97

See application file for complete search history.

(56) References Cited

U.S. PATENT DOCUMENTS

| | | | | |
|---|---|---|---|---|
| 5,535,012 | A | 7/1996 | Matsumoto et al. | |
| 6,826,374 | B2 | 11/2004 | Kato et al. | |
| 7,458,570 | B2 * | 12/2008 | Ueda et al. | 271/97 |
| 7,540,489 | B2 * | 6/2009 | Kushida | 271/98 |
| 7,575,231 | B2 | 8/2009 | Sasaki et al. | |
| 7,591,459 | B2 | 9/2009 | Matsumoto et al. | |
| 8,083,223 | B2 * | 12/2011 | Ikeda | 271/145 |
| 2005/0206068 | A1 | 9/2005 | Sasaki et al. | |
| 2009/0250865 | A1 | 10/2009 | Matsumoto | |
| 2010/0295237 | A1 | 11/2010 | Matsumoto | |
| 2011/0012301 | A1 | 1/2011 | Fukatsu et al. | |

* cited by examiner

*Primary Examiner* — Luis A Gonzalez

(74) *Attorney, Agent, or Firm* — Fitzpatrick, Cella, Harper & Scinto

(57) ABSTRACT

A sheet feeding apparatus includes a back end detecting sensor which detects a back end side in a conveying direction of the topmost sheet stacked on the sheet tray, a front end detecting sensor which detects a front end side in the conveying direction of the topmost sheet, and a CPU. The CPU disables start of a sheet feeding operation of a feeding unit in a case where the back end detecting sensor and the front end detecting sensor do not detect the sheet when the sheet tray is lifted toward the feeding unit and then stopped in a predetermined position. Accordingly, a state that a feeding failure is possibly caused is detected before feeding the sheets so as to eliminate the wasteful feeding operation.

12 Claims, 26 Drawing Sheets

*FIG. 8A*

!!ALARM!!

--PLEASE OPEN STORAGE CASE AND CHECK FOLLOWING TWO ITEMS.

*1. PLEASE CHECK IF BACK END REGULATING PLATE IS PROPERLY SET.*

→ IF BACK END REGULATING PLATE IS NOT PROPERLY SET, PLEASE SET IT SO AS TO ABUT ON BACK END OF SHEET.

→ IF IT IS PROPERLY SET, PLEASE CHECK ITEM 2.

*2. CURL AMOUNT OF SHEET IN STORAGE CASE MIGHT BE LARGE.*

→ RECOMMENDED IS TO TURN SHEET UPSIDE DOWN OR REPLACE SHEET ITSELF.

OK

*FIG. 8B*

!!ALARM!!

-- PLEASE OPEN STORAGE CASE AND CHECK FOLLOWING ITEM.

*• CURL AMOUNT OF SHEET IN STORAGE CASE MIGHT BE LARGE.*

→ RECOMMENDED IS TO TURN SHEET UPSIDE DOWN OR REPLACE SHEET ITSELF.

OK

SHEET FEEDING APPARATUS AND IMAGE FORMING APPARATUS

BACKGROUND OF THE INVENTION

1. Field of the Invention

The present invention relates to a sheet feeding apparatus which suctions and conveys sheets by blowing air on a sheet bundle to separate from one another, and the present invention also relates to an image forming apparatus having the sheet feeding apparatus.

2. Description of the Related Art

In the related art, such an image forming apparatus, for example, a printer or a copying machine, which has a sheet feeding apparatus for conveying sheets by feeding one by one from a sheet storage case, has been known. In recent years, a sheet feeding apparatus of a so-called air feeding type has been proposed in order to realize a high-speed conveyance of sheets, in which a gas (mainly air) is blown on the end of a sheet bundle to float up several sheets to separate from one another, and convey the separated sheet by suctioning it to a suction conveyance belt. The technique is described in U.S. Patent Application Publication No. 2005/206068 A1.

Herein, an exemplary sheet feeding apparatus of the air feeding type will be described with reference to FIG. 18A to FIG. 20B. FIG. 18A is a schematic side view illustrating a conventional sheet feeding apparatus; FIG. 18B is a schematic plan view illustrating the conventional sheet feeding apparatus; and FIGS. 19A and 20B are views each illustrating a sheet feeding operation of the conventional sheet feeding apparatus.

As illustrated in FIG. 18A, a sheet storage portion (storage case) 11 of a sheet feeding apparatus includes a sheet tray 12 on which a sheet bundle is stacked. The sheet storage portion 11 also includes a back end regulating member 13 configured to regulate a back end side of the sheets in a sheet conveying direction, the sheets being stacked on the sheet tray 12, and side end regulating members 14, 16 configured to regulate a width direction of the sheets perpendicular to the sheet conveying direction. The sheet storage portion 11 is configured to be drawn out toward a front side in the drawing by means of a slide rail 15 so as to enable sheets to be added, drawing out the sheet storage portion 11.

As illustrated in FIG. 18B, the back end regulating member 13 and the side end regulating members 14, 16 are configured to be adjustable in position in directions of arrows Q, R in the drawing, according to a size of sheet 35 (the maximum L: indicated by a dashed-two dotted line in the drawing, the minimum S: indicated by a dashed-dotted line in the drawing). The back end regulating member 13 and the side end regulating members 14, 16 need to regulate sheets in various sizes, so that the sheet tray 12 has a shape indicated as a shaded area in the drawing.

A feeding operation of the sheet feeding apparatus of the air feeding type will be described next with reference to FIGS. 19A and 20B. In a state illustrated in FIG. 19A, when a user retracts the sheet storage portion 11 after drawing it out to set the sheets therein, the sheet tray 12 starts to lift in a direction of arrow A in the drawing by means of a driving portion (not illustrated). The sheet tray 12 is then stopped in a position in which a distance from a suction conveyance belt 21 reaches size B, and waits for a feeing signal.

In a state illustrated in FIG. 19B, upon detection of the feeding signal, a loosening and separating air supplying portion 31 is activated to absorb air in a direction of arrow C in the drawing. This absorbed air is passed through a separating duct 32 and is then blown on sheets 35 (hereinafter, also referred to as a sheet bundle 35) through a loosening nozzle 33 and a separating nozzle 34 in directions of arrow D and arrow E, respectively. The top several sheets (indicated by 35A) are blown up from the sheet bundle 35 on which the air has been blown. On the other hand, a suction fan 36 is activated to blow air in a direction of arrow F in the drawing. At this time, a suction shutter 37 is still closed. Further, the side end regulating portions 14, 16 are mounted with auxiliary separating fans 17, 18, respectively, and the air is blown from openings 14A, 16A to the top of the sheet bundle 35. Formation of the auxiliary separating fans 17, 18 further ensures blowing up of sheets, thereby certainly loosening them.

As illustrated in a state in FIG. 20A, the suction shutter 37 is rotated in a direction of arrow G when a predetermined time has elapsed from detection of the feeding signal and the blowing up of the sheets 35A becomes stable. Accordingly, suction force in a direction of arrow H in the drawing is generated from a number of suction holes (not illustrated), formed in the suction conveyance belt 21, so that the topmost sheet 35B is suctioned onto the suction conveyance belt 21.

As illustrated in a state in FIG. 20B, the topmost sheet 35B is conveyed in a direction of arrow K in the drawing by rotating belt driving rollers 41, 41 for supporting the suction conveyance belt 21, in a direction of arrow J in the drawing. Thereafter, a drawing roller 42 is rotated in directions of arrows M, P, in the drawing so that the topmost sheet is conveyed to a conveyance path on the downstream side.

Incidentally, if the back end regulating member or the side end regulating members for the sheets is not set in a proper position, a sheet feeding failure is caused. For example, as illustrated in FIG. 21A, if the loosening and separating air supplying portion 31 is activated with the back end regulating member 13 being set improperly, problems would be caused as follows. In a case where the air is blown on the sheet bundle 35 from the loosening nozzle 33 and the separating nozzle 34 through the separating duct 32, in directions of arrows D, E, respectively, as illustrated in FIG. 21B, the top several sheets (35A) of the sheet bundle 35 are shifted backward (toward the back end side). Therefore, even if the suction shutter 37 is rotated in a direction of arrow G as illustrated in FIG. 21C, the topmost sheet 35B is not suctioned onto the suction conveyance belt 21, thereby causing the feeding failure as illustrated in FIG. 21D.

Further, such a feeding failure is also caused like the above case if side end regulating members 14*a*, 14*b* are not properly set as illustrated in FIGS. 22A, 22B each illustrating the feet feeding apparatus as viewed from the top. More specifically, in a case where the air is blown on the sheet bundle 35 from the loosening nozzle 33 and the separating nozzle 34 through the separating duct 32, respectively, the top several sheets of the sheets 35 are laterally shifted as illustrated in FIG. 22C. Therefore, even if the suction shutter 37 is rotated in a direction of arrow G in FIG. 16, the topmost sheet 35B is not suctioned onto the suction conveyance belt 21, thereby leading to the feeding failure.

Herein, problems caused when the side end regulating members are not placed in proper positions will be described with reference to FIG. 19A. As illustrated in FIGS. 22A, 22B each illustrating the sheet feeding apparatus as viewed from the top, if the loosening and separating air supplying portion 31 is activated with the side end regulating members 14*a*, 14*b* being set improperly, problems would be caused as follows. More specifically, when the air is blown on the sheet bundle 35 from the loosening nozzle 33 and the separating nozzle 34 through the separating duct 32, respectively, the top several sheets of the sheet bundle 35 are laterally shifted as illustrated in FIG. 22C. Therefore, the topmost sheet 35B is not certainly suctioned onto the suction conveyance belt 21, thereby causing the feeding failure.

Further, in a case where the sheets are fed on the condition that the sheets stacked on the sheet tray 12 are prominently curled up, it could be difficult to carry out the normal feeding in some cases. More specifically, for example, a suction failure of sheets due to the curl on the sheet may lead to the feeding failure.

SUMMARY OF THE INVENTION

Thus, the present invention provides a sheet feeding apparatus of an air feeding type which can eliminate a wasteful feeding operation by detecting a state that a feeding failure is possibly caused before the sheet feeding operation and an image forming apparatus having the sheet feeding apparatus.

A sheet feeding apparatus according to the present invention includes a sheet stacking portion capable of lifting and lowering, on which sheets are stacked, an air blowing portion which blows air on a side face of the sheets stacked on the sheet stacking portion to loosen the sheets, a suction conveyance portion which suctions and conveys the sheets loosened by the air blowing portion, a driving portion which drives the sheet stacking portion to lift and lower with respect to the suction conveyance portion, a back end regulating member which regulates a position of a back end in a conveying direction of the sheets stacked on the sheet stacking portion, a back end detecting portion which is arranged on the back end regulating member and detects a back end side in the conveying direction of a topmost sheet of the sheets stacked on the sheet stacking portion, a front end detecting portion which detects a front end side in the conveying direction of the topmost sheet of the sheets stacked on the sheet stacking portion, and a controlling portion which performs control to disable start of a sheet feeding operation of the suction conveyance portion in a case where the back end detecting portion and the front end detecting portion do not detect the sheets when the driving portion is controlled so that the sheet stacking portion lifts toward the suction conveyance portion and stops in a predetermined position.

Further features of the present invention will become apparent from the following description of exemplary embodiments with reference to the attached drawings.

BRIEF DESCRIPTION OF THE DRAWINGS

FIGS. 8A and 8B are views illustrating an alarm displayed on an operation screen;

DESCRIPTION OF THE EMBODIMENTS (First Embodiment)

Figure 5:
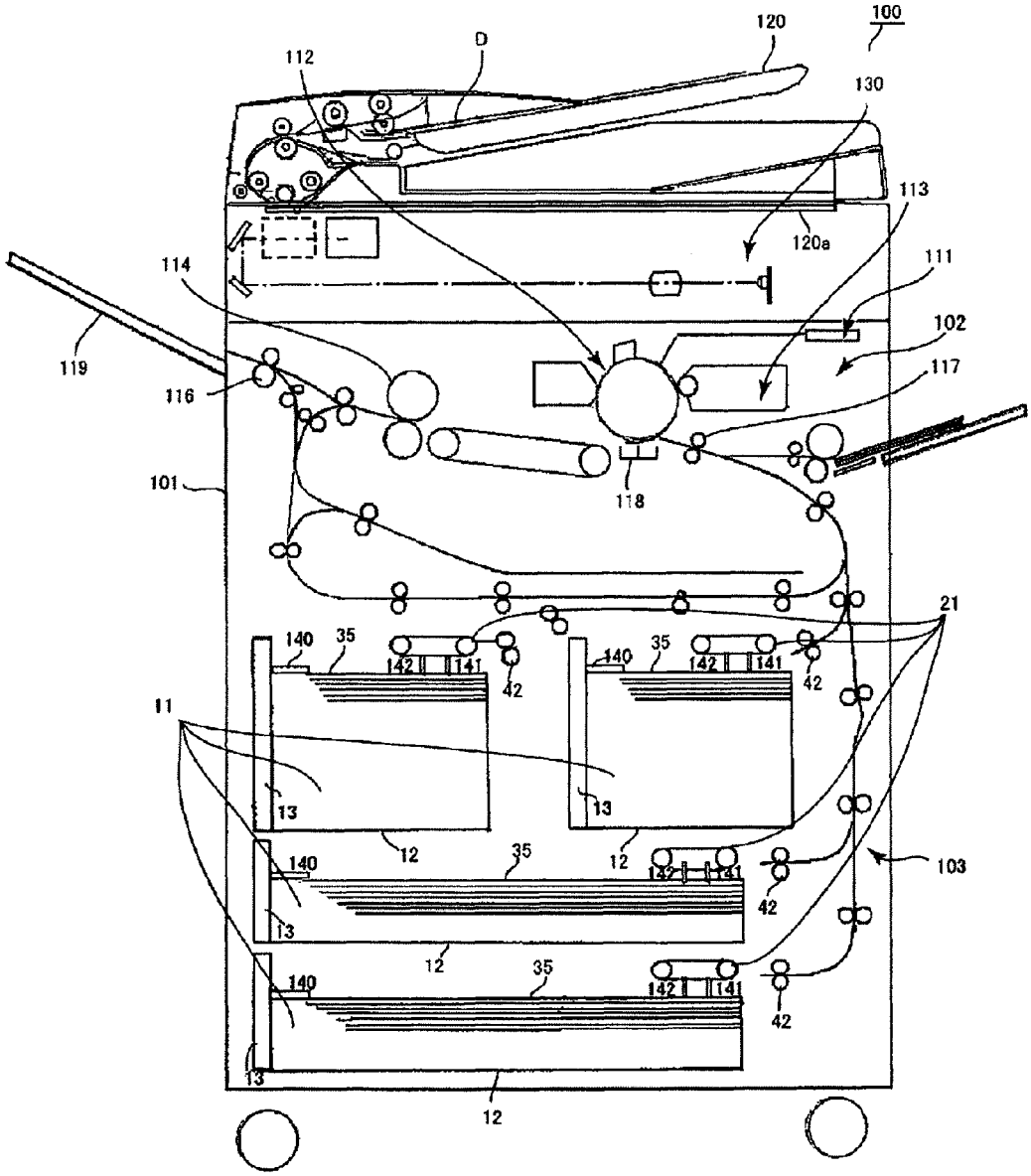
FIG. 5 is a schematic view illustrating an overall configuration of an image forming apparatus according to the present invention.

Embodiments of the present invention will be described in detail with reference to the drawings. FIG. 5 is a schematic cross section view illustrating a printer as an image forming apparatus having a sheet feeding apparatus according to the present invention.

As illustrated in FIG. 5, a printer 100 includes a printer main body 101. An upper portion of this printer main body 101 is provided with an image reading portion 130 configured to read by means of an automatic original conveying apparatus 120, an original D placed on a platen glass 120*a* as an original placing platen. Further, an image forming portion 102 configured to form an image on the sheet 35 fed from the sheet tray 12, and a sheet feeding apparatus 103 configured to feed the sheets 35 to the image forming portion 102 are provided below the image reading portion 130. The printer 100 according to the embodiment includes this sheet feeding apparatus 103, thereby being configured as an image forming apparatus capable of achieving high reliability.

Herein, the image forming portion 102 has, e.g., a photosensitive drum 112, a development device 113, and a laser scanner unit 111. Further, the sheet feeding apparatus 103 includes, e.g., a plurality of (four in the embodiment) sheet storage portions 11 for storing the sheets 35, detachably attached to the printer main body 101, and a suction conveyance belt 21 for sending out the sheets 35 stored in the sheet storage portions 11. A configuration including this suction conveyance belt 21, for suctioning and sending out the sheet, is unitized. It is to be noted that the drawing illustrates a drawing roller 42, a fixing portion 114, a discharge roller 116, and a discharge tray 119.

Next, the image forming operation of the printer 100 having the above configuration will be described. More specifically, when a controlling apparatus arranged in the printer main body 101 outputs an image reading signal to the image reading portion 130, the automatic original conveying apparatus 120 automatically conveys the original D to a reading position so that the image reading portion 130 reads image information.

The read image information is processed by a controller (not illustrated) and according to a signal based on the processing result, the laser scanner unit 111 emits a laser beam corresponding to an electrical signal, and irradiates the photosensitive drum 112. At this time, the photosensitive drum 112 is previously charged. An electrostatic latent image is formed by irradiation of the laser beam and then developed by the development device 113, thereby forming a toner image on the photosensitive drum 112.

On the other hand, when a feeding signal is output from a CPU 301 (see FIG. 7) inside the printer main body 101 to the sheet feeding device 103, the sheets 35 such as a paper or an OHT stored in the sheet storage portion 11 are sent out by the feeding apparatus including, e.g., the suction conveyance belt 21. Thereafter, the fed sheets 35 are brought into sync with the toner image on the photosensitive drum 112 by means of a registration roller 117, and are fed to a transfer portion including the photosensitive drum 112 and a transfer charger 118. Then, the sheet 35 fed to the transfer portion is, after the toner image is transferred thereto, conveyed to the fixing portion 114. The sheet 35 is thereafter heated and pressed by the fixing portion 114 so as to fix the image on the sheet 35. The sheet 35 on which the image has been fixed as described above is then discharged by the discharge roller 116 from the printer main body 101 to the discharge tray 119.

Figure 1A:
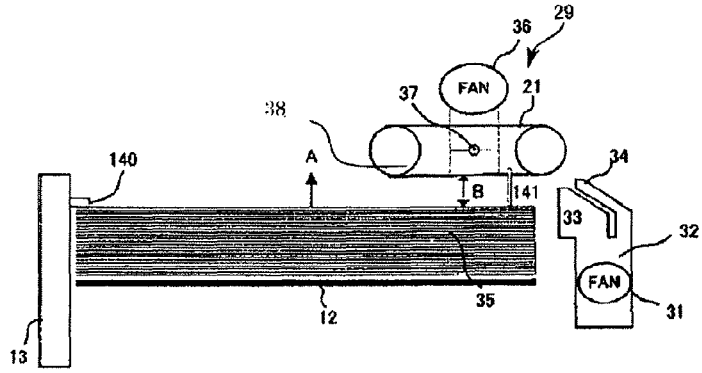
FIGS. 1A to 1D are schematic views illustrating a sheet feeding apparatus in a normal operation state according to a first embodiment of the present invention.
Figure 1B:
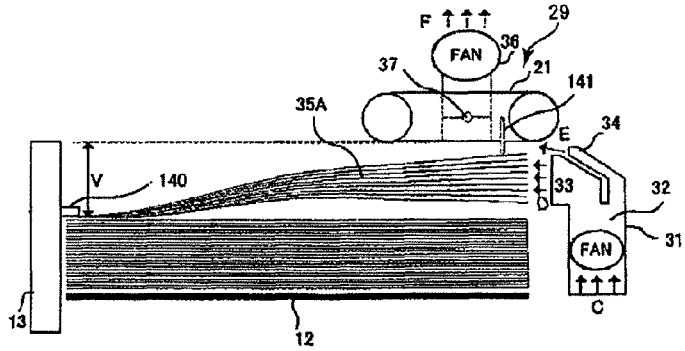
Figure 7:
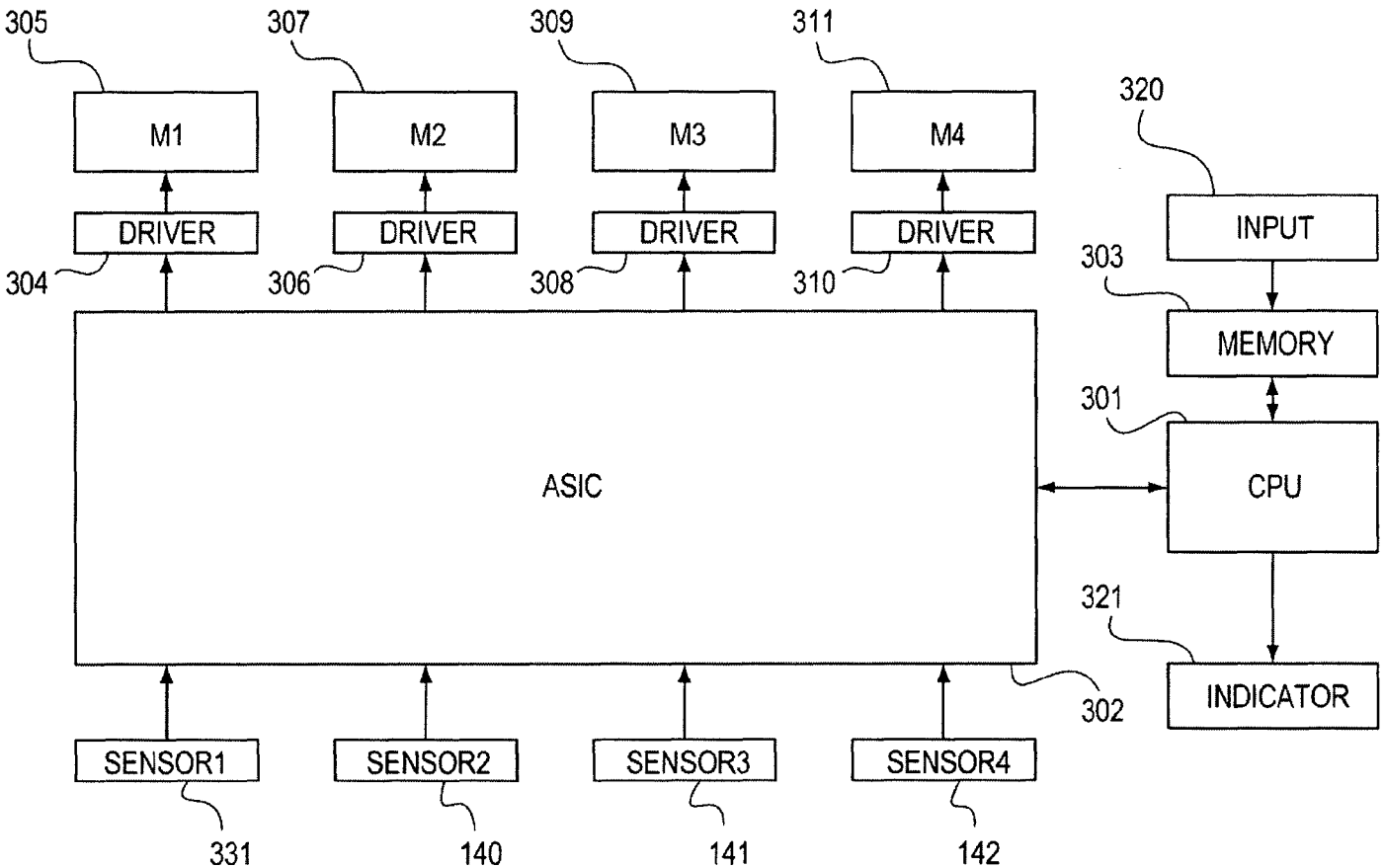
FIG. 7 is a block diagram illustrating a circuit configuration of the sheet feeding apparatus according to the present invention.

Next, details on the sheet feeding apparatus 103 according to the present invention will be described with reference to FIGS. 1A and 7. FIGS. 1A and 1B are schematic views illustrating this sheet feeding apparatus 103 in a normal operation state and FIG. 7 is a block diagram illustrating a circuit configuration of this sheet feeding apparatus 103.

As illustrated in FIGS. 1A to 1D, the sheet feeding apparatus 103 includes the sheet tray 12 as a sheet stacking portion capable of lifting and lowering, on which the sheets 35 are stacked, and a lifter motor 305 (illustrated in FIG. 7) as a driving portion which drives the sheet tray 12 to lift and lower. The sheet feeding apparatus 103 includes the loosening and separating air supplying portion 31 and a feeding unit 29 as a suction conveyance portion which suctions and conveys the sheet 35 loosened by the loosening and separating air supplying portion 31. The loosening and separating air supplying portion 31 configures an air blowing portion which blows air to loosen the sheets 35 stacked on the sheet tray 12, from a front side (front end side of the sheets) in a sheet conveying direction.

The feeding unit 29 includes the suction conveyance belt 21, a duct 38 arranged at an inner side of the suction conveyance belt 21, the suction fan 36 for setting an inside of the duct 38 to be non-pressurized, and the suction shutter 37 arranged inside the duct 38. The feeding unit 29 is provided with a front end detecting sensor 141 as a front end detecting portion which detects a position at a front end side in the conveying direction of the topmost sheet 35B of the sheets 35 stacked on the sheet tray 12. Each of the sheet storage portions 11 includes a back end regulating member 13 on its rear portion, which regulates a position of a back end in the conveying direction of the sheets 35 stacked on the sheet tray 12 as a sheet stacking portion. The back end regulating member 13 is provided with a back end detecting sensor 140 as a back end detecting portion which detects a back end side (upper end side) in the conveying direction of the topmost sheet 35B of the sheets 35 stacked on the sheet tray 12. Further, an intermediate detecting sensor 142 (illustrated in FIGS. 6A and 6B) as an intermediate detecting portion which detects the topmost sheet 35B of the sheets 35 stacked on the sheet tray 12 is provided between the back end detecting sensor 140 and the front end detecting sensor 141. It is to be noted, as described below, that a configuration not provided with the intermediate detecting sensor 142 is also adaptable. The back end detecting sensor 140, the front end detecting sensor 141, and the intermediate detecting sensor 142 generally include a reflection-type sensor or a light-blocking type sensor. However, a detection type is not limited thereto.

Further, the loosening and separating air supplying portion 31 includes the loosening nozzle 33 and the separating nozzle 34 both of which are facing the end portion of the sheet bundle 35 stacked on the sheet tray 12, and also includes the separating duct 32 for sending air to these nozzles 33, 34.

As illustrated in FIG. 7, the CPU 301 as a controlling portion which controls the sheet feeding apparatus 103 is connected to a memory 303, an ASIC 302 intended for driving various loads of, e.g., a motor in the sheet feeding apparatus 103, and a display portion 321. The CPU 301 controls the lifter motor 305 as a driving portion so as to lift the sheet tray 12 toward the feeding unit 29 and stop it in a position in which the topmost sheet 35B reaches a predetermined position. This predetermined position in which the sheet tray 12 is to be stopped is set to a position in which the topmost sheet 35B can be properly blown up by the air blown by the loosening and separating air supplying portion 31 (a position having a distance B between the suction conveyance belt 21 and the topmost sheet 35). The CPU 301 lifts the sheet tray 12 by means of the lifter motor 305 and stops it at a time that the intermediate detecting sensor 142 detects the topmost sheet 35B of the sheets 35 stacked on the sheet tray 12. In this manner, the topmost sheet 35B of the sheets 35 stacked on the sheet tray 12 is placed in the predetermined position.

The memory 303 stores various pieces of information on, e.g., alarm display contents such as illustrated in FIGS. 8A and 8B, a driving velocity, a rotation duty of a fan, and a travel distance of the sheet tray 12. The memory 303 is connected to an input portion 320 by which information on, e.g., a size or material of the sheet is input to the memory 303.

The ASIC 302 issues a driving start command to a driving circuit for driving each of loads of the sheet feeding apparatus 103. The ASIC 302 is connected to the lifter motor 305 as a driving portion configured to lift and lower the sheet tray 12, via a driver 304 which controls this lifter motor 305. The ASIC 302 is connected to a suction shutter driving motor 307 configured to control driving of the suction shutter 37, via the driver 306 which controls this suction shutter driving motor 307. The ASIC 302 is connected to a belt driving motor 309 configured to control the suction conveyance belt 21, via a driver 308 which controls driving of this belt driving motor 309. The ASIC 302 is connected to a drawing motor 311 configured to drive the drawing roller 42, via a driver 310 which controls driving of this drawing motor 311.

The ASIC 302 is connected to a storage case open/close detecting sensor 331 which detects an open/close state of the sheet storage portion (storage case) 11, and the back end detecting sensor 140 which detects the back end of the sheets 35 stacked on the sheet tray 12. Further, the ASIC 302 is connected to the front end detecting sensor 141 which detects the front end of the sheets 35 stacked on the sheet tray 12, and the intermediate detecting sensor 142.

When the storage case open/close detecting sensor 331 detects a state that the sheet storage portion 11 has been closed, the ASIC 302 outputs a signal for driving the lifter motor 305 in a lifting direction. This signal becomes input to the driver 304 for controlling the lifter motor 305 and therefore, driving of the lifter motor 305 is controlled so as to lift the sheet tray 12. The sheet tray 12 is stopped when a distance between the topmost sheet 35B of the sheets 35 on the sheet tray 12 and the suction conveyance belt 21 reaches a predetermined position. Driving of the lifter motor 305 is controlled so as to stop the sheet tray 12 when the intermediate detecting sensor 142 is turned on. It is to be noted that an operation for stopping the sheet tray 12 so as to set the topmost sheet 35B of the sheets 35 on the sheet tray 12 in the predetermined position is controlled based on detection by the intermediate detecting sensor 142 but such a control is not limitative thereto. For example, if a height of the sheets 35 stacked on the sheet tray 12 is previously known, the number of counts in a stopped position of the sheet tray 12 is calculated based on a travel distance of the sheet tray 12 so that the sheet tray 12 can be stopped by counting the calculated number of counts by means of a counter or the like. Further, the sheet tray 12 may be stopped so as to set the topmost sheet 35B in a predetermined position based on detection by either one of the back end detecting sensor 140 and the front end detecting sensor 141.

If the sheets 35 are in a normal state when the topmost sheet 35B of the sheets 35 on the sheet tray 12 is stopped in the predetermined position, both the back end detecting sensor 140 and the front end detecting sensor 141 detect the sheet face. Therefore, if neither of the back end detecting sensor 140 and the front end detecting sensor 141 detects a sheet, a state is determined to be abnormal. More specifically, it is contemplated that the back end regulating member 13 is not properly set or that a large curl appears in the sheets 35 stacked on the sheet tray 12. In a case where the front end detecting sensor 141 detects a sheet face (upper face) of the topmost sheet 35B whereas the back end detecting sensor 140 does not detect a sheet face, control is performed so that the alarm contents stored in the memory 303 are displayed on the display portion 321. At the same time, the ASIC 302 may input a signal to the driver 304 of the lifter motor 305 so as to lower the sheet tray 12 by a predetermined amount.

In a case where a downward curl appears in the sheets 35 stacked on the sheet tray 12, the back end detecting sensor 140 detects a sheet face of the topmost sheet 35B but the front end detecting sensor 141 does not detect a sheet face. In such a case, control is performed so that the alarm contents stored in the memory 303 are displayed on the display portion 321. At the same time, the ASIC 302 may input a signal to the driver 304 of the lifter motor 305 so as to lower the sheet tray 12 by a predetermined amount.

In a case where the sheets 35 stacked on the sheet tray 12 have a large downward curl at each of the front and the back, the intermediate detecting sensor 142 detects a sheet face of the topmost sheet 35B whereas the back end detecting sensor 140 and the front end paper detecting sensor 141 do not detect a sheet face. In such a case, control is performed so that the alarm contents stored in the memory 303 are displayed on the display portion 321. At the same time, the ASIC 302 may input a signal to the driver 304 of the lifter motor 305 so as to lower the sheet tray 12 by a predetermined amount.

The sheet feeding apparatus 103 according to the embodiment employs the purpose-built ASIC 302 to control various loads of, e.g., a motor in the sheet feeding apparatus 103. However, such a control is not limitative thereto and the CPU 301 may control loads directly without the ASIC 302.

Next, a state in which the back end regulating member 13 is properly set will be described with reference to FIGS. 1A to 1D. In FIGS. 1A to 1D, when a user retracts the sheet storage portion (storage case) 11 after drawing it out to set the sheets therein, the sheet tray 12 starts to lift in a direction of arrow A in the drawing in response to activation of the lifter motor 305 (see FIG. 7). The CPU 301 as a controlling portion stops the sheet tray 12 in a position (predetermined position) in which a distance between the suction conveyance belt 21 and the topmost sheet 35 reaches B, and waits for a feeing signal (FIG. 1A).

Upon detection of the feeding signal, the CPU 301 activates the loosening and separating air supply portion 31 which is disposed near the front end of the sheet tray 12, whereby air is suctioned in a direction of arrow C in the drawing (FIG. 1B). This absorbed air is passed through the separating duct 32 of the loosening and separating air supplying portion 31 and is then blown on the sheet bundle 35 through the loosening nozzle 33 and the separating nozzle 34 in directions of arrows D, E, respectively, so that the top several sheets (35A) of the sheet bundle 35 are blown up as illustrated in the drawing.

On the other hand, the CPU 301 activates the suction fan 36 configured to generate a negative pressure used to suction the sheets 35 onto the suction conveyance belt 21, whereby air is blown in a direction of arrow F in the drawing. At this time, the suction shutter 37 is closed (FIG. 1B). In this case, the back end detecting sensor 140 and the front end detecting sensor 141 detect the topmost sheet face and herein, a position of the sheet tray 12 is controlled so that a distance in a perpendicular direction (vertical direction) between the back end detecting sensor 140 and the suction conveyance belt 21 is set to V.

Figure 1C:
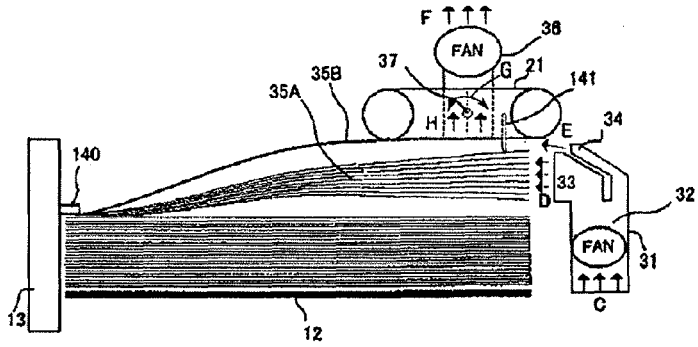
Figure 1D:
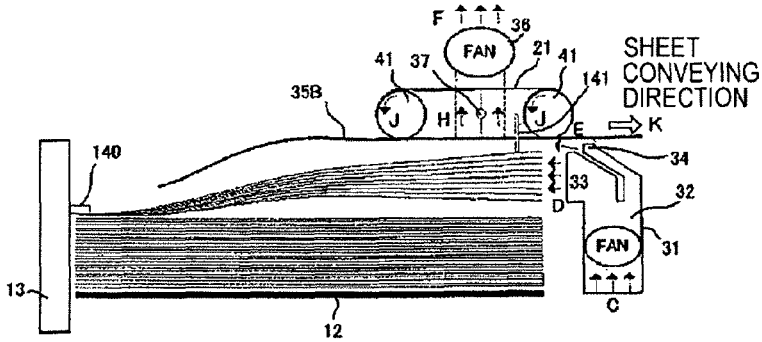

In FIG. 1C, the suction shutter 37 is rotated in a direction of arrow G when a predetermined time has elapsed from detection of the feeding signal and the blowing up of the sheet 35A becomes stable. Rotation of the suction shutter 37 causes a negative pressure in the duct 38 by means of the suction fan 36, thereby generating suction force in a direction of arrow H from suction holes (not illustrated), formed in the suction conveyance belt 21, so that the topmost sheet 35B is suctioned onto the suction conveyance belt 21. In FIG. 1D, the topmost sheet 35B is conveyed in a direction of arrow K by rotating the belt driving rollers 41, 41 for supporting the suction conveyance belt 21 at its front and back ends, in a direction of arrow J in the drawing. The drawing roller 42 is then rotated so that the topmost sheet 35B is conveyed to the conveyance path on the downstream side, and then, conveyed to the image forming portion.

Figure 2A:
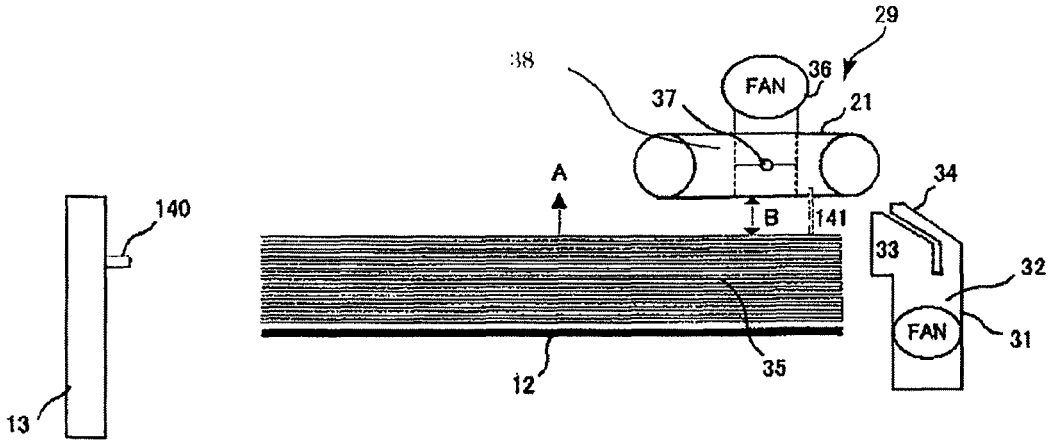
FIGS. 2A and 2B are schematic side views illustrating a problem caused in a case where a back end regulating member is not properly set in the sheet feeding apparatus.
Figure 2B:
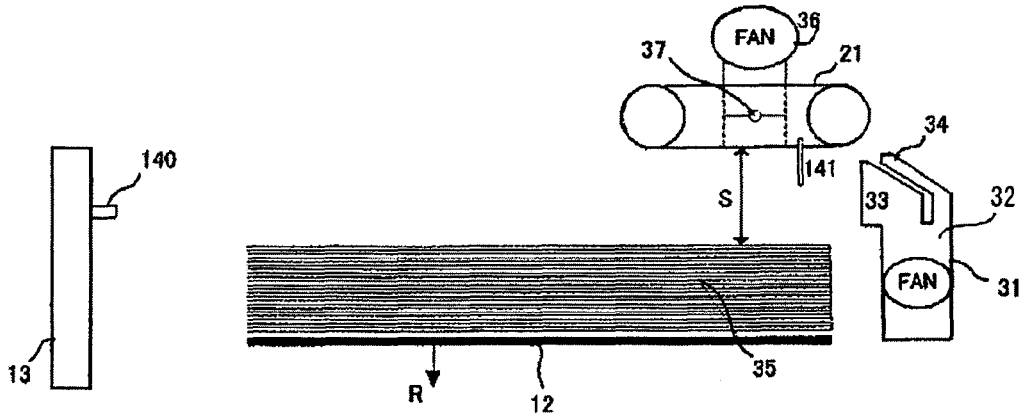

With reference to FIGS. 2A and 2B, next described is a case where the back end regulating member 13 is not properly set. In FIGS. 2A and 2B, when the user retracts the sheet storage portion 11 after drawing it out to set the sheets therein, the sheet tray 12 starts to lift in a direction of arrow A in the drawing in response to activation of the lifter motor 305. The sheet tray 12 is then stopped in a position in which a distance between the suction conveyance belt 21 and the topmost sheet 35 reaches B (FIG. 2A).

This case results in a state in which the front end detecting sensor 141 detects a sheet face of the topmost sheet 35B of the sheets 35 whereas the back end detecting sensor 140 does not detect the sheet face of the sheet 35B. In such a state, occurrence of the feeding failure such as described above is assumed even if the feeding of the sheet 35B is started, so that the loosening and separating air supplying portion 31 and the feeding unit 29 are controlled so as not to enable start of the feeding operation. More specifically, the sheet feeding operation is disabled. In such a case, the sheet tray (lifter tray) 12 may be controlled to lower in a direction of arrow R in the drawing by a predetermined amount (herein, a distance between the suction conveyance belt 21 and the topmost sheet being set to S (S>B)) so as to facilitate setting of the back end regulating member 13 (FIG. 2B).

Figure 3A:
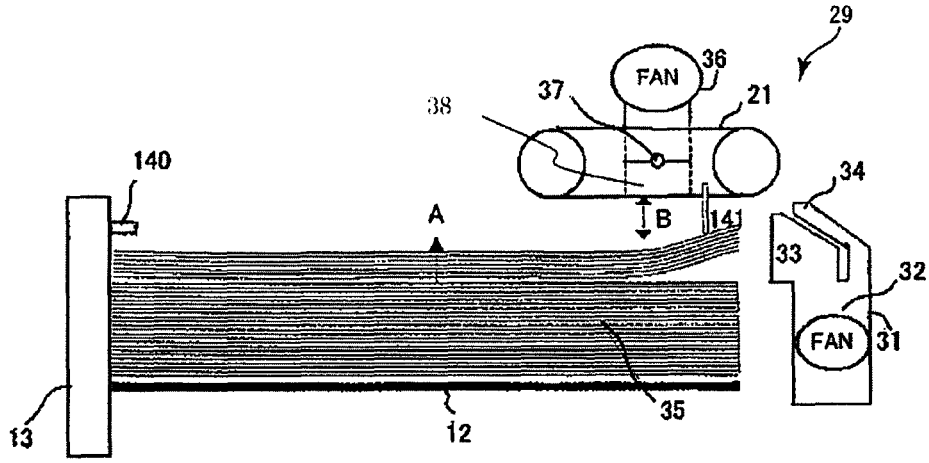
FIGS. 3A and 3B are schematic side views illustrating a case where a curl (upward curl at a front end) of sheet is large in the sheet feeding apparatus.

Next, a case where the back end regulating member 13 is properly set while the back end detecting sensor 140 does not make a proper detection will be described with reference to FIGS. 3A and 3B. In such a case, as illustrated in FIG. 3A, it is contemplated that the sheets 35 stacked on the sheet tray 12 have a large upward curl at the front end. In FIG. 3A, when a user retracts the sheet storage portion 11 after drawing it out to set the sheets therein, the sheet tray 12 starts to lift in a direction of arrow A in the drawing by means of the lifter motor 305. The sheet tray 12 is stopped in a position in which a distance between the suction conveyance belt 21 and the topmost sheet 35 reaches B.

Also in such a case, the front end detecting sensor 141 detects an upper face of the sheets 35 whereas the back end detecting sensor 140 does not detect the upper face of the sheets 35. In such a state, occurrence of the feeding failure such as described above is assumed even if the feeding of the sheet 35B is started, so that the loosening and separating air supplying portion 31 and the feeding unit 29 are controlled so as not to enable start of the feeding operation. Further, in such a case, the sheet tray 12 may be controlled to lower in a direction of arrow R in the drawing by a predetermined amount (herein, a distance between the suction conveyance belt 21 and the topmost sheet being set to S) (FIG. 3B) so that a state of the sheets 35 inside the sheet storage portion 11 can be easily checked.

Figure 3B:
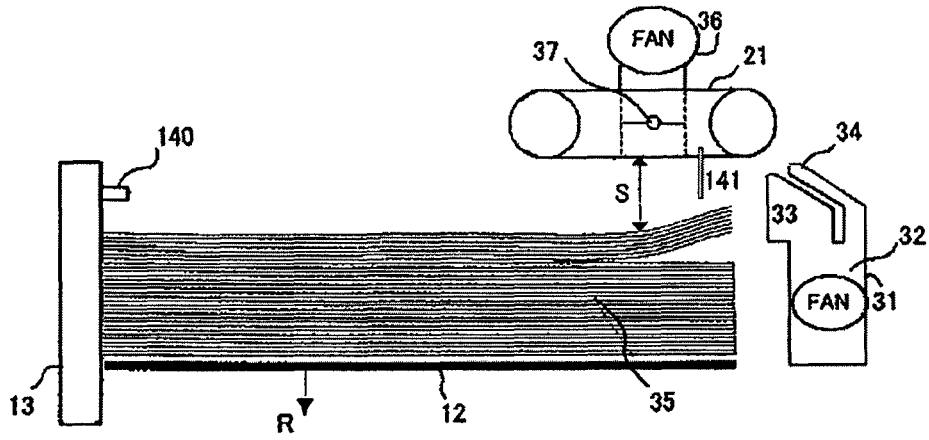

In FIGS. 2A and 3B, in a case where the front end detecting sensor 141 detects the sheet face of the sheets 35 whereas the back end detecting sensor 140 does not detect the sheet face of the sheets 35, the CPU 301 performs control so as not to enable start of the feeding operation. At the same time, the CPU 301 also performs control to display an alarm (display indicative of a state that the back end regulating member 13 is not properly positioned or the sheets stacked on the sheet tray 12 are not in a proper state) such as illustrated in FIGS. 8A and 8B, on the operation screen (display portion 321 in FIG. 7) of the printer 100. More specifically, the CPU 301 as a controlling portion performs control so as to issue an alarm having predetermined contents at a time of disabling start of the sheet feeding operation. Meanwhile, in a case of issuing the alarm with the predetermined contents, a configuration for giving an announcement is also applicable other than a configuration of the alarm display.

When the back end regulating member 13 is properly set or the sheet storage portion 11 is retracted after the sheet bundle 35 on the sheet tray 12 has been replaced or turned upside down, the sheet tray 12 starts to lift in a direction of arrow A in the drawing by means of the lifter motor 305. Further, the sheet tray 12 is stopped in a position in which a distance between the suction conveyance belt 21 and the topmost sheet reaches B, and control is performed to determine as to whether a state is right or wrong. It is to be noted that the alarm display in FIG. 8A is one example and is not limitative as long as such a display is easily understandable to a user.

Figure 4A:
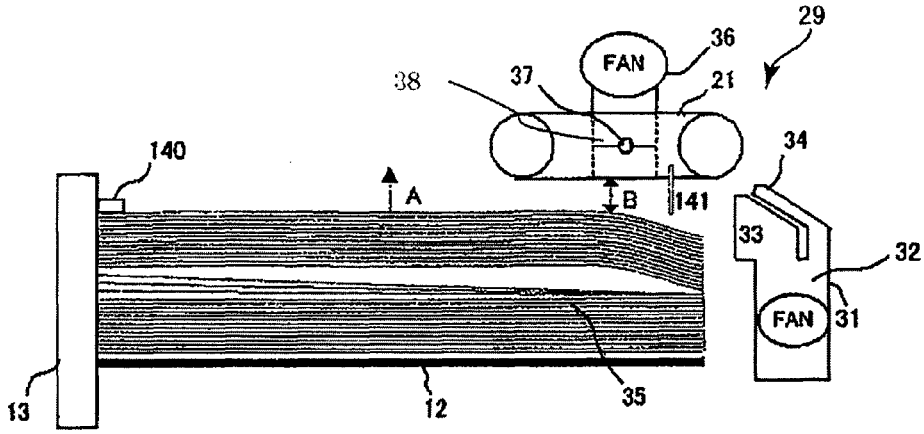
FIGS. 4A and 4B are schematic side views illustrating a case where a curl (downward curl at the front end) of the sheet is large in the sheet feeding apparatus.
Figure 4B:
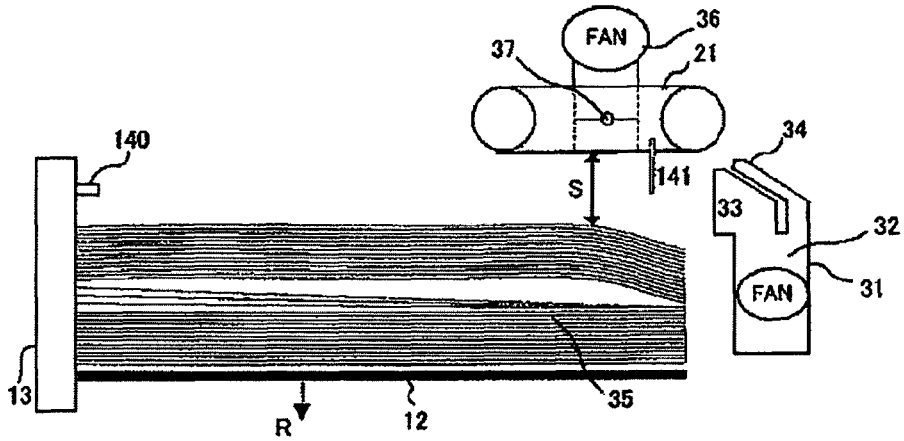

Next described with reference to FIGS. 4A and 4B is a case where the back end regulating member 13 is properly set whereas the front end detecting sensor 141 does not detect the sheet face. In such a case, it is contemplated that the sheets 35 stacked on the sheet tray 12 have a large downward curl at the front end as illustrated in FIG. 4A. In FIG. 4A, when a user retracts the sheet storage portion (storage case) 11 after drawing it out to set the sheets therein, the sheet tray 12 starts to lift in a direction of arrow A in the drawing by means of the lifter motor 305. The sheet tray 12 is stopped in a position in which a distance between the suction conveyance belt 21 and the topmost sheet reaches B.

In such a state, occurrence of the feeding failure such as described above is assumed even if the feeding of the sheets 35 is started, so that the loosening and separating air supplying portion 31 and the feeding unit 29 are controlled so as not to enable start of the feeding operation. In such a case, the sheet tray 12 may be controlled to lower in a direction of arrow R in the drawing by a predetermined amount (herein, a distance between the suction conveyance belt 21 and the topmost sheet being set to S) so that a state of the sheets 35 inside the sheet storage portion 11 (inside the case) can be easily checked (FIG. 4B).

In FIGS. 4A and 4B, in a case where the back end detecting sensor 140 detects the sheet face of the sheets 35 whereas the front end detecting sensor 141 does not detect the sheet face of the sheets 35, the CPU 301 performs control so as not enable start of the feeding operation. At the same time, the CPU 301 performs control so as to display such an alarm as illustrated in FIG. 8B on the display portion 321 of the printer 100. The sheet storage portion 11 is retracted in the predetermined position after the sheets 35 on the sheet tray 12 has been replaced or turned upside down, the sheet tray 12 starts to lift in a direction of arrow A in the drawing by means of the lifter motor 305. Further, the sheet tray 12 is stopped in a position in which a distance between the suction conveyance belt 21 and the topmost sheet reaches B, and control is performed to determine as to whether a state is right or wrong. It is to be noted that the alarm display in FIG. 8B is one example and is not limitative as long as such a display is easily understandable to a user.

Figure 6A:
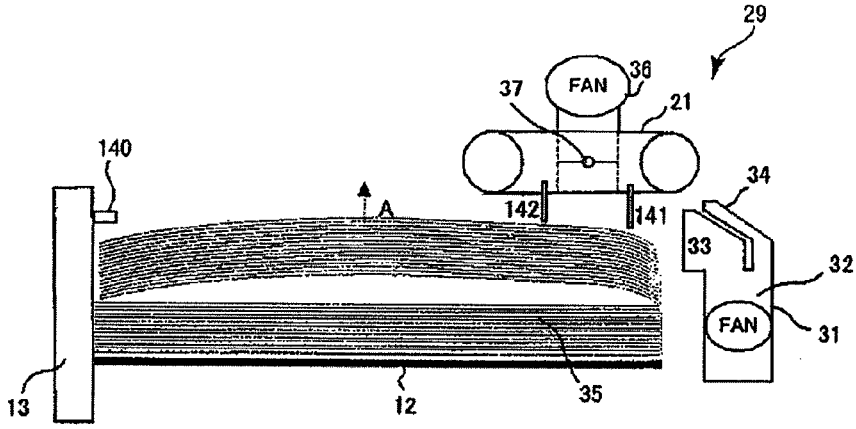
FIGS. 6A and 6B are schematic side views illustrating a case where a curl (downward curls at front and end sides) of the sheet is large in the sheet feeding apparatus.
Figure 6B:
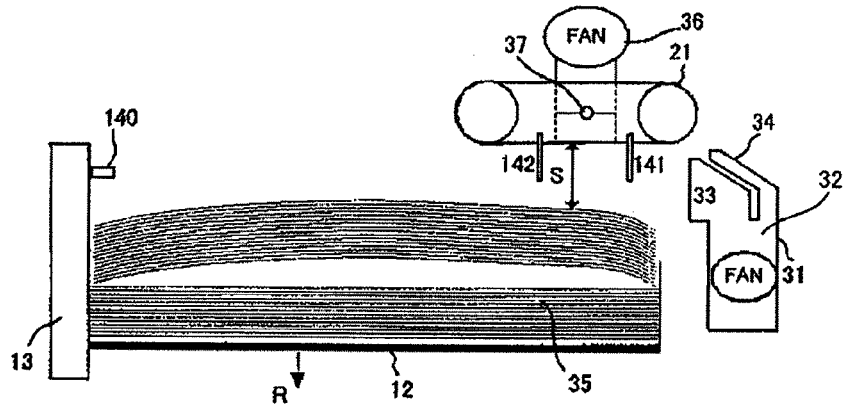

Next described with reference to FIGS. 6A and 6B is a care where the back end regulating member 13 is properly set whereas neither of the back end detecting sensor 140 and the front end detecting sensor 141 detects the sheet face. In such a case, it is contemplated that the sheets 35 stacked on the sheet tray 12 have large downward curls at the front and back ends illustrated in FIG. 6A. In FIG. 6A, when a user retracts the sheet storage portion 11 after drawing it out to set the sheets therein, the sheet tray 12 starts to lift in a direction of arrow A in the drawing by means of the lifter motor 305. When the intermediate detecting sensor 142 detects the sheets 35, the sheet tray 12 is stopped under control of the CPU 301.

In such a state, occurrence of the feeding failure such as described above is assumed even if the feeding of the sheets is started, so that the loosening and separating air supplying portion 31 and the feeding unit 29 are controlled so as not enable start of the feeding operation. In such a case, the sheet tray 12 may be controlled to lower in a direction of arrow R in the drawing by a predetermined amount (herein, to the degree that a distance between the suction conveyance belt 21 and the topmost sheet reaches to S) (FIG. 6B) so that a state of the sheets 35 inside the sheet storage portion 11 can be easily checked.

Figure 9:
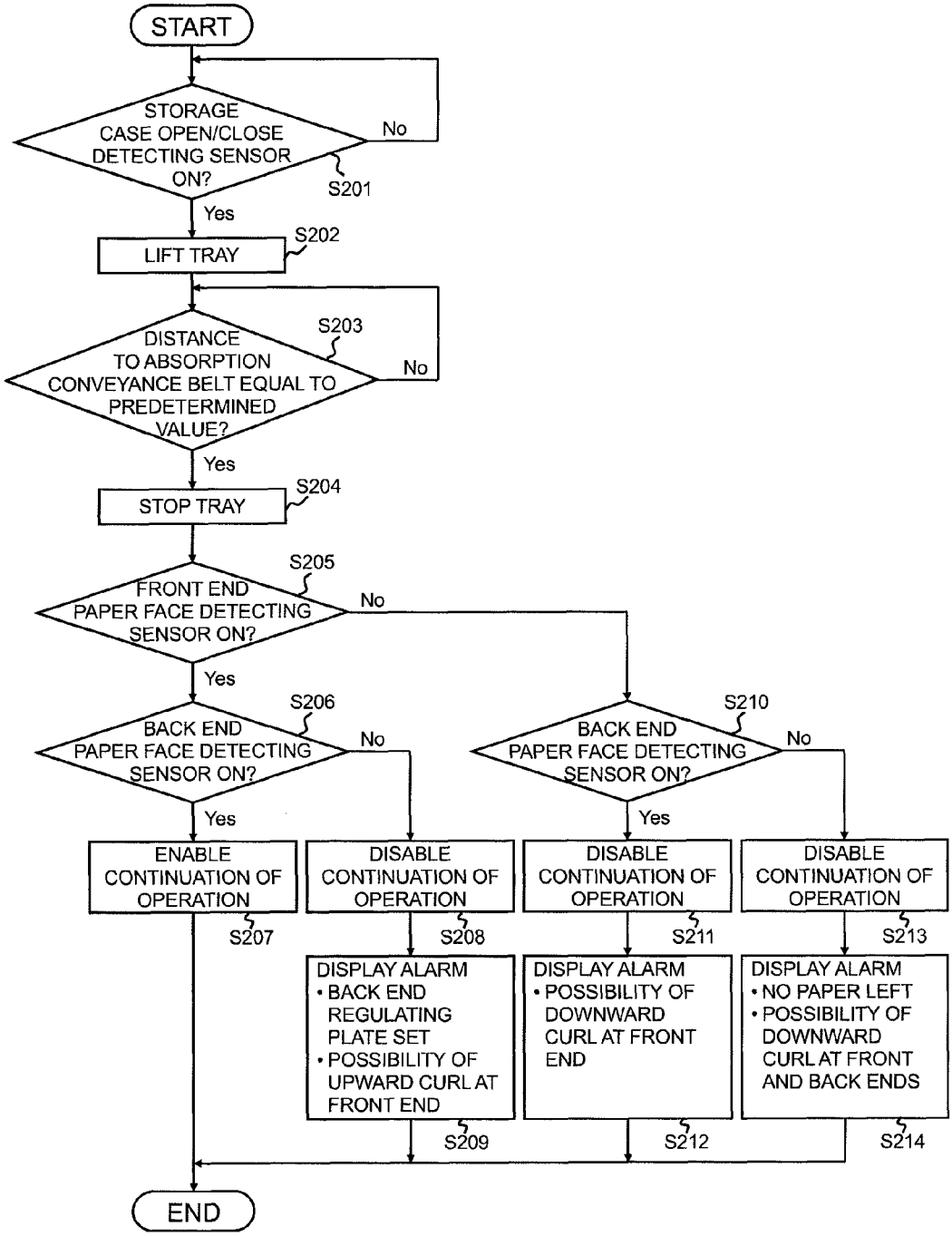
FIG. 9 is a flowchart illustrating an effect of the first embodiment.

In FIGS. 6A and 6B, in a case where neither of the back end detecting sensor 140 and the front end detecting sensor 141 detects the sheet face of the sheets 35, the CPU 301 performs control so as not to enable start of the feeding operation. At the same time, the CPU 301 performs control so as to display such an alarm as illustrated in FIG. 9 on the display portion 321 of the printer 100.

The sheet storage portion 11 is retracted in the predetermined position after the sheets 35 on the sheet tray 12 have been replaced or turned upside down, the sheet tray 12 starts to lift in a direction of arrow A in the drawing by means of the lifter motor 305. Further, the sheet tray 12 is stopped in a position in which a distance between the suction conveyance belt 21 and the topmost sheet reaches B, and control is performed to determine as to whether a state is right or wrong.

Further, a curl state of the sheets 35 stacked on the sheet tray 12 may get worse while the sheets 35 are left on the sheet tray 12 for a long time. Therefore, the aforementioned control may be performed, even during standby, by always monitoring a state of the back end detecting sensor 140 and the front end detecting sensor 141.

Figure 10A:
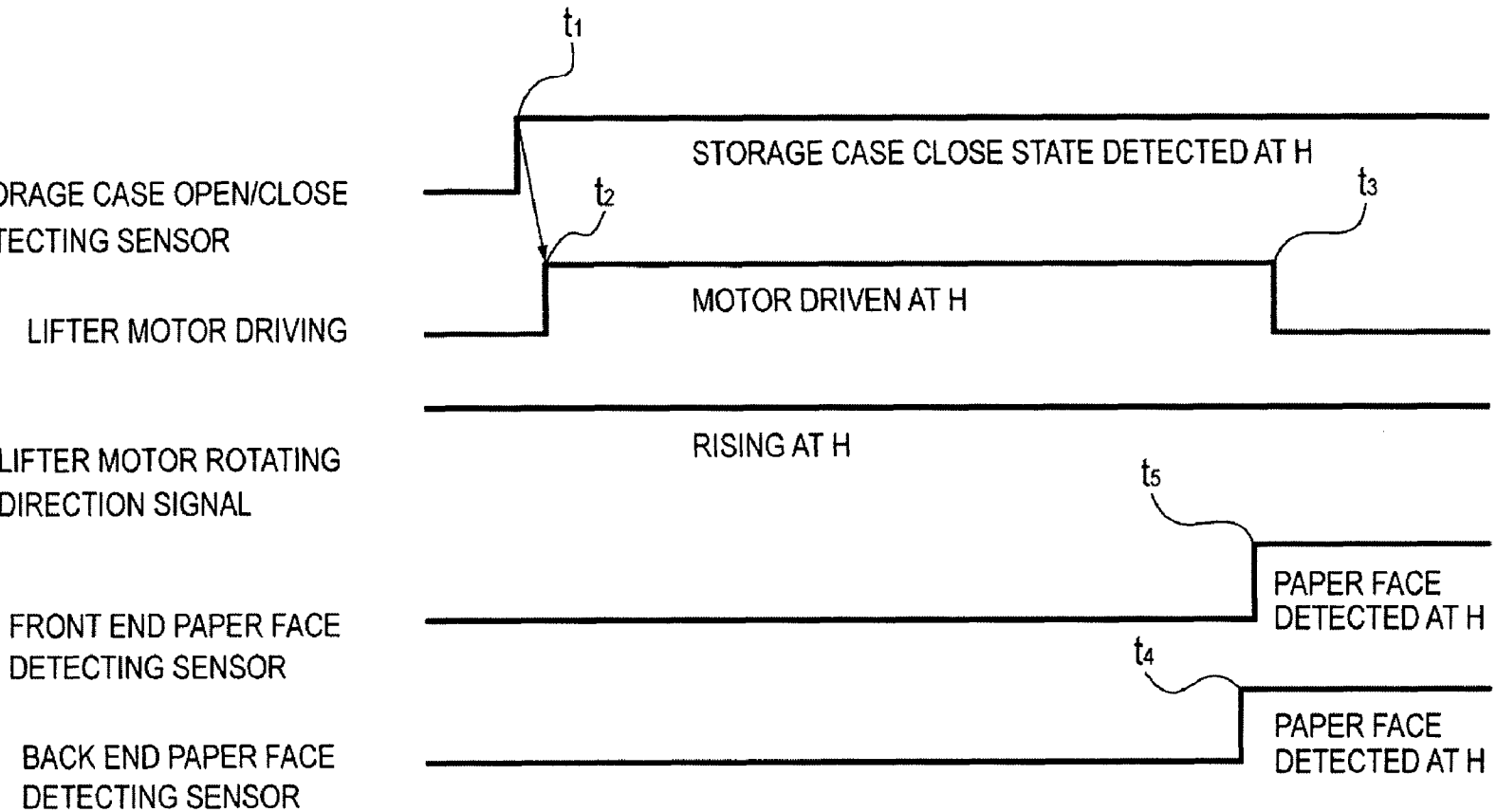
FIGS. 10A and 10B are timing charts illustrating a signal at a time of a normal operation according to the first embodiment.

Herein, described with reference to a timing chart of FIG. 10A is a timing of signals in a case where the back end regulating member 13 is properly set and the sheets 35 stacked on the sheet tray 12 are free from a curl.

When the storage case open/close detecting sensor 331 detects a state that the sheet storage portion 11 has been closed ($t_1$), control is performed so as to lift the sheet tray 12 ($t_2$). The sheet tray 12 is then stopped when a distance between the topmost sheet 35B and the suction conveyance belt 21 reaches B ($t_3$). In this case, the back end detecting sensor 140 and the front end detecting sensor 141 detect the sheet face at the same time ($t_4$, $t_5$). The back end detecting sensor 140 and the front end detecting sensor 141 may be arranged so as to have a difference in a position (in level) for detecting the sheet face or may be arranged in the same position (in level).

Figure 10B:
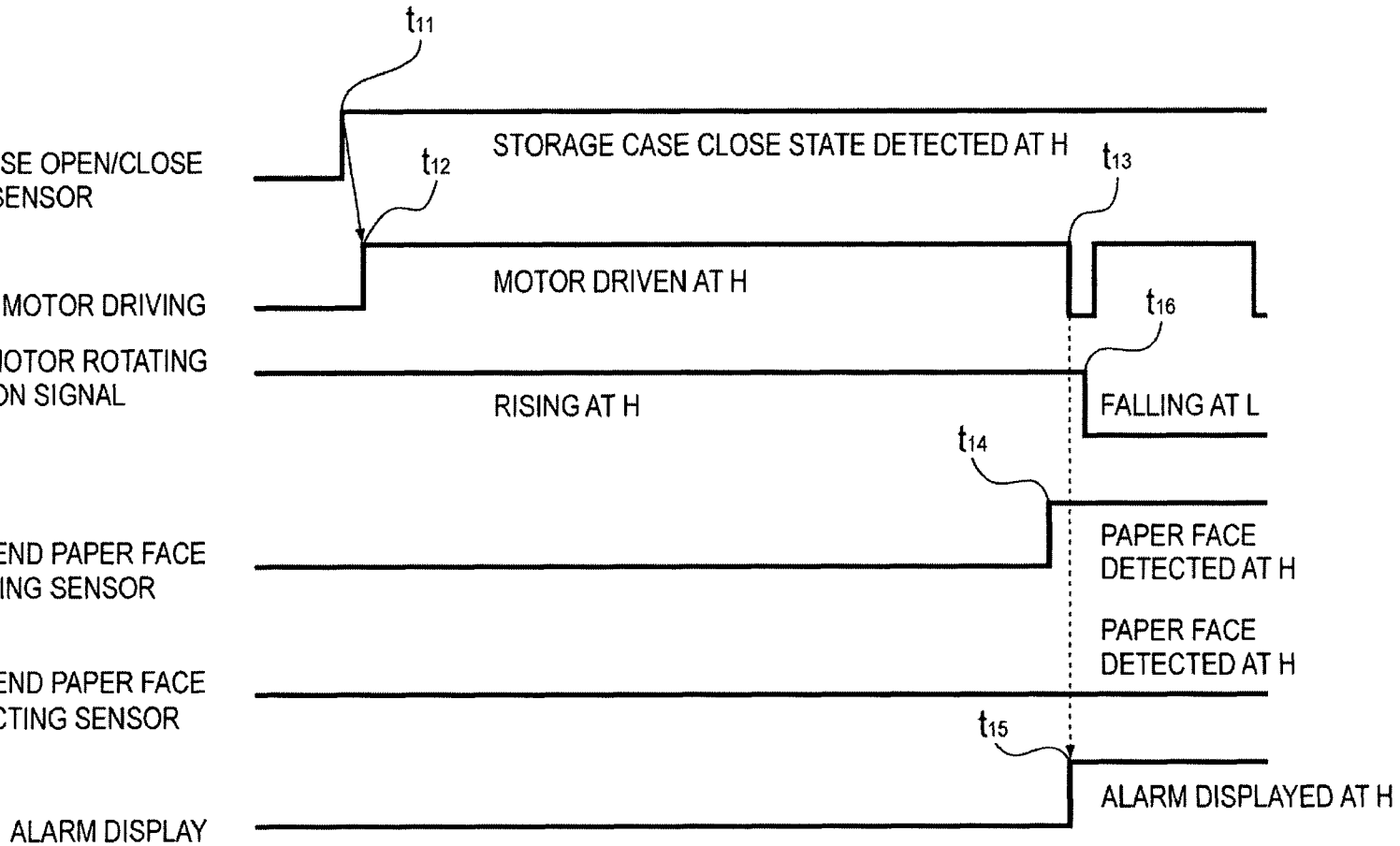

Next, described with reference to a timing chart of FIG. 10B is as for a timing of signals in a case where the back end regulating member 13 is not properly set or the sheets stacked on the sheet tray 12 have a large upward curl.

When the storage case open/close detecting sensor 331 detects a state that the sheet storage portion 11 has been closed ($t_{11}$), control is performed so as to lift the sheet tray 12 ($t_{12}$). The sheet tray 12 is then stopped when a distance between the topmost sheet and the suction conveyance belt 21 reaches B ($t_{13}$). At this time, the front end detecting sensor 141 detects a sheet face ($t_{14}$) whereas the back end detecting sensor 140 does not detect the sheet face.

As described above, in a case where both of the sensors 140, 141 do not detect the sheet at the same time when the sheet tray 12 is stopped in the predetermined position, the CPU 301 disables start of the sheet feeding operation carried out by the feeding unit 29. At the same time, the CPU 301 performs control so as to display an alarm illustrated in FIG. 8A when stopping a driving operation for lifting of the lifter motor 305 ($t_{15}$). Further, the lifter motor 305 may be controlled to execute a driving operation for lowering when a predetermined time has elapsed after stop of the lifting operation of the lifter motor 305 ($t_{16}$).

Figure 11A:
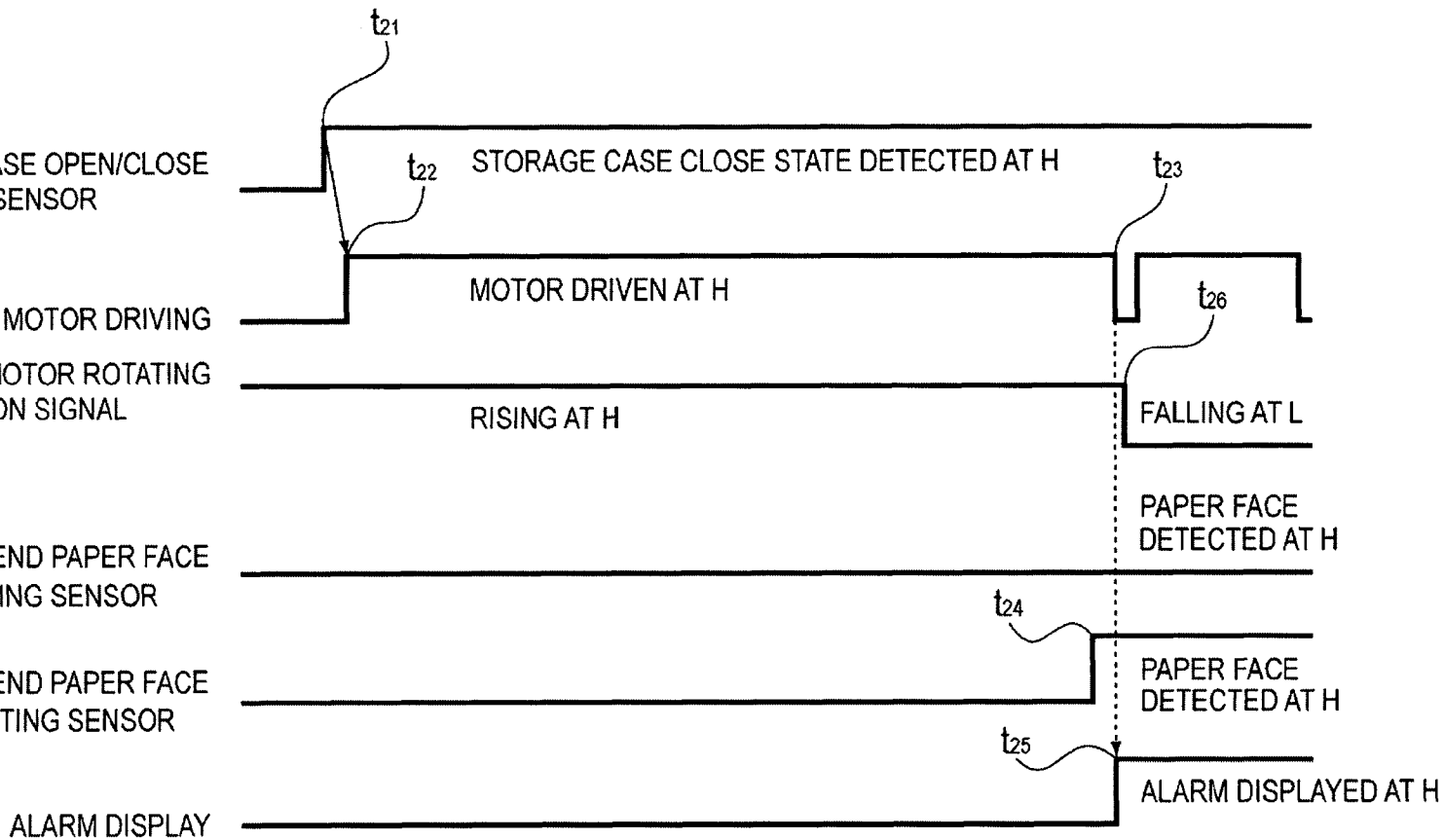
FIGS. 11A and 11B are timing charts illustrating a signal at a time of a normal operation in the first embodiment.

Next, described with reference to a timing chart of FIG. 11A is a timing of signals in a case where the back end regulating member 13 is properly set while the sheets 35 stacked on the sheet tray 12 have a large downward curl.

When the storage case open/close detecting sensor 331 detects a state that the sheet storage portion 11 has been closed ($t_{21}$), control is performed so as to lift the sheet tray 12 ($t_{22}$). The sheet tray 12 is then stopped when a distance between the topmost sheet and the suction conveyance belt 21 reaches B ($t_{23}$). At this time, the back end detecting sensor 140 detects a sheet face ($t_{24}$) whereas the front end detecting sensor 141 does not detect the sheet face.

As described above, in a case where both of the sensors 140, 141 do not detect the sheet simultaneously when the sheet tray 12 is stopped in the predetermined position, the CPU 301 disables start of the sheet feeding operation carried out by the feeding unit 29. At the same time, the CPU 301 performs control so as to display an alarm illustrated in FIG. 8B when stopping a driving operation for lifting of the lifter motor 305 ($t_{25}$). Further, the lifter motor 305 may be controlled to execute a driving operation for lowering when a predetermined time has elapsed after stop of the lifting operation of the lifter motor 305 ($t_{26}$).

Figure 11B:
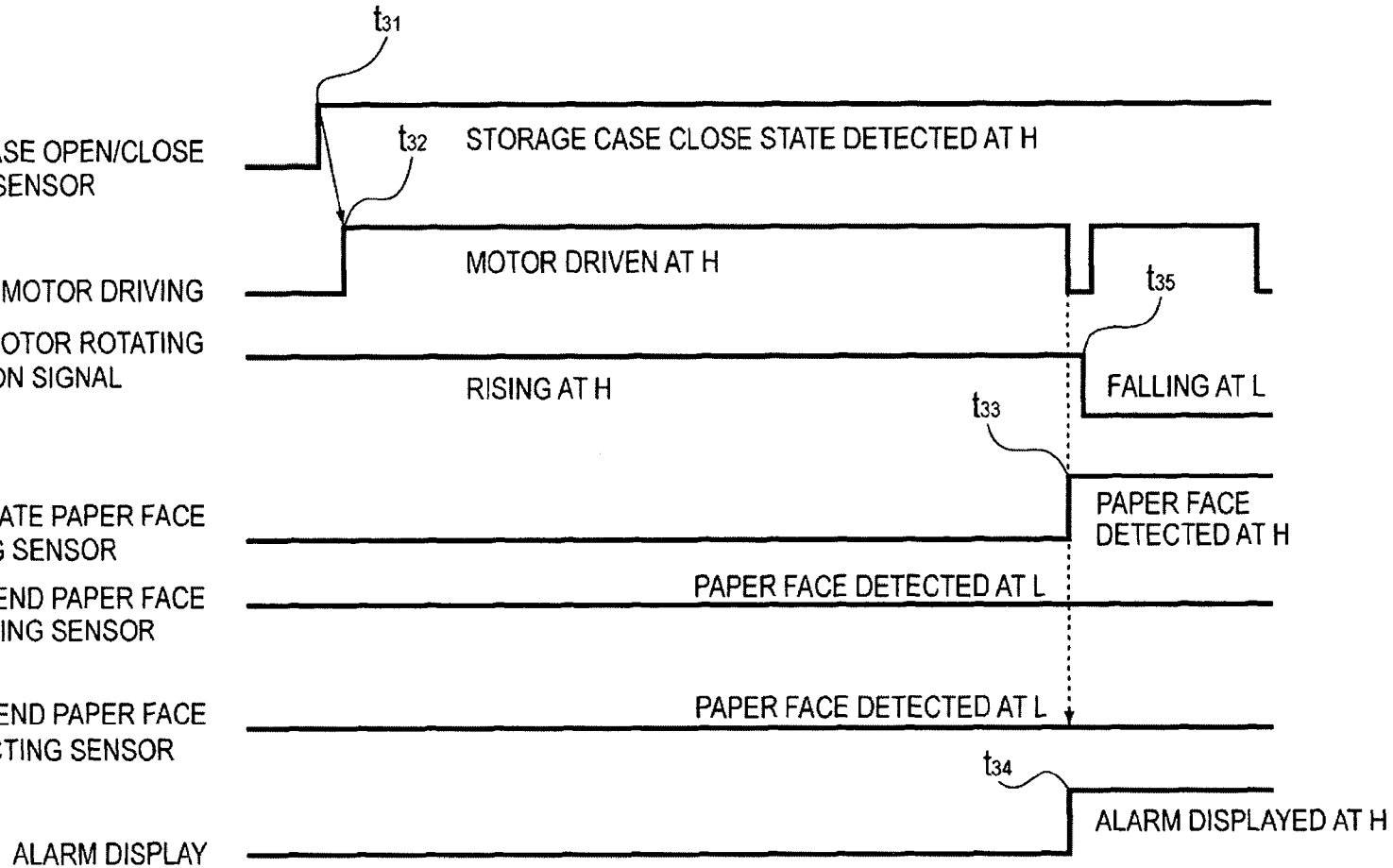
Figure 14A:
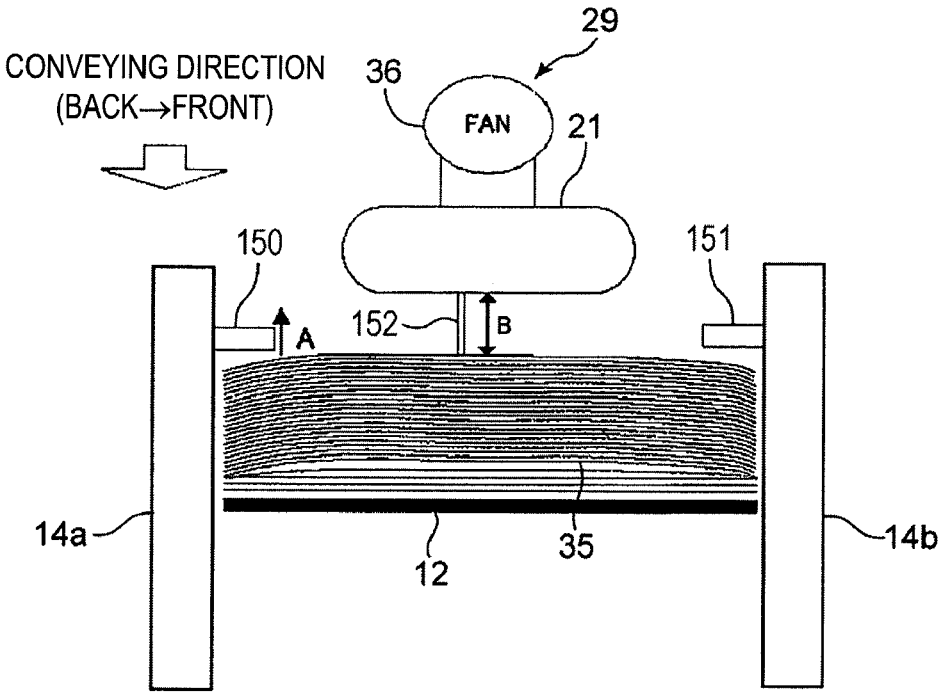
FIGS. 14A and 14B are views illustrating a case where a curl (downward curl) is large in the sheet feeding apparatus.
Figure 14B:
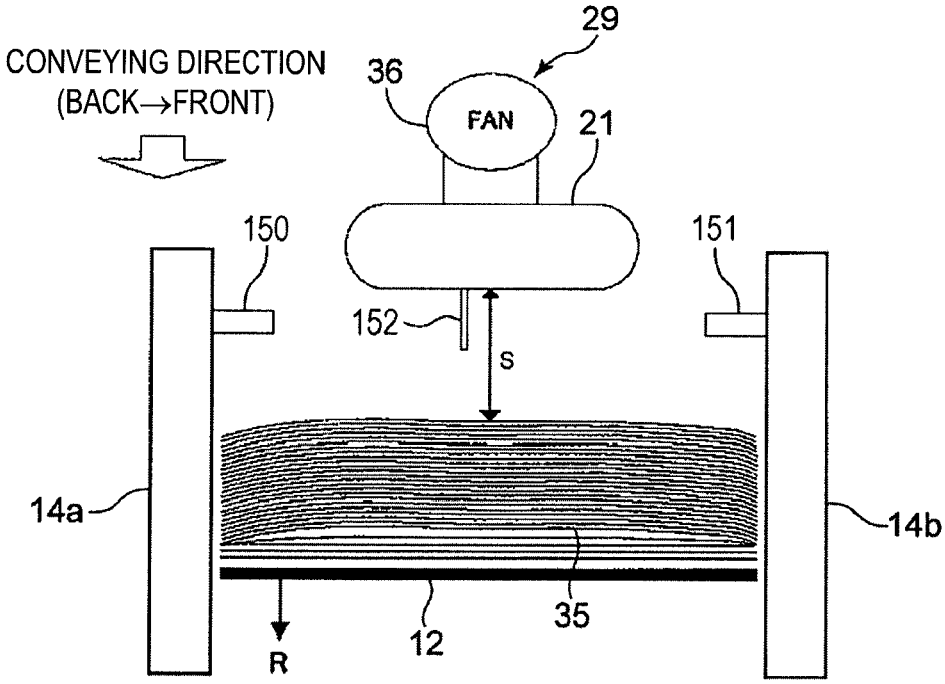

Next, described with reference to a timing chart in FIGS. 14A and 14B is a timing of signals in a case where the back end regulating member 13 is properly set while the sheets 35 stacked on the sheet tray 12 have a large downward curl at each of the front and back. It is to be noted that in a control example herein, the intermediate detecting sensor 142 detects the sheet face at a high level (H) as illustrated in FIG. 11B while in FIGS. 10A, 10B, and 11A, the back end detecting sensor 140 and the front end detecting sensor 141 are turned on to detect the sheet face at a high level (H). The back end detecting sensor 140 and the front end detecting sensor 141 are configured to detect the sheet face at a low level (L).

When the storage case open/close detecting sensor 331 detects a state that the sheet storage portion 11 has been closed ($t_{31}$), control is performed so as to lift the sheet tray 12 by driving of the lifter motor 305 ($t_{32}$). The sheet tray 12 is stopped in a position (predetermined position) in which the intermediate detecting sensor 142 is turned on ($t_{33}$). At this time, the back end detecting sensor 140 and the front end detecting sensor 141 are both at L, and do not detect the sheet face.

As described above, in a case where both of the sensors 140, 141 do not detect the sheet simultaneously when the sheet tray 12 is stopped in the predetermined position, the CPU 301 disables start of the sheet feeding operation carried out by the feeding unit 29. At the same time, the CPU 301 performs control so as to display an'alarm illustrated in FIG. 9 when stopping the driving operation for lifting of the lifter motor 305 ($t_{34}$). Further, the lifter motor 305 may be controlled to execute a driving operation for lowering when a predetermined time has elapsed after stop of the lifting operation of the lifter motor 305 ($t_{35}$)

Next, an advantageous effect of the embodiment will be described with reference to a flowchart in FIG. 9. When the storage case open/close detecting sensor 331 detects a state that the sheet storage portion (storage case) 11 has been closed (S201), the CPU 301 performs control so as to lift the sheet tray (tray) 12 by controlling the lifter motor 305 (S202). If a close state of the sheet storage portion 11 is not detected at step S201, an operation stands and waits until when the sheet storage portion 11 is closed.

The lifter motor 305 is controlled so as to lift the sheet tray 12, and a determination is made at step S203 as to whether a distance between the suction conveyance belt 21 and the topmost sheet reaches a predetermined value (that is, a predetermined position). As a result, if the distance has reached the predetermined value, driving of the lifter motor 305 is stopped to stop the sheet tray 12 (S204). At this time, if the front end detecting sensor 141 is turned on and detects the sheet face at step S205, the operation shifts to step S206. If the back end detecting sensor 140 is also turned on at step S206

(that is, the back end detecting sensor 140 and the front end detecting sensor 141 detect the sheet simultaneously), the CPU 301 performs control to enable continuation of the subsequent operation (start of the sheet feeding operation of the feeding unit 29) (S207).

On the other hand, if the back end detecting sensor 140 does not detect the sheet face at step S206, the CPU 306 performs control to disable continuation of the subsequent operation, i.e., start of the sheet feeding operation of the feeding unit 29 (S208). Further, the processing shifts to step S209, in which the CPU 301 performs control to display an alarm illustrated in FIG. 8A. Although it is not illustrated, the sheet tray 12 may be controlled to lower by a predetermined amount in association with step S209.

If the front end detecting sensor 141 does not detect the sheet face at step S205, the processing shifts to step S210. If the back end detecting sensor 140 detects the sheet face, the CPU 301 performs control so as to disable continuation of the subsequent operation (S211). Further, the processing shifts to step S212 to perform control so as to display an alarm illustrated in FIG. 8B. Although it is not illustrated, the sheet tray 12 may be controlled to lower by a predetermined amount in association with step S212.

On the other hand, if the back end detecting sensor 140 does not detect the sheet face at step S210, the CPU 301 performs control so as to disable continuation of the subsequent operation (S213). Further, the processing shifts to step S214 to perform control so as to display an alarm illustrated in FIG. 8B. Although it is not illustrated, the sheet tray 12 may be controlled to lower by a predetermined amount in association with step S214.

While a determination is made herein at step S203 as to whether a distance to the suction conveyance belt 21 reaches a predetermined value, such a configuration is also applicable that lifting of the sheet tray 12 is stopped based on a determination as to whether the intermediate detecting sensor 142 is turned on.

(Second Embodiment)

A second embodiment of the present invention will be described next. While an exemplary solution to a problem caused when the back end regulating member is not placed in a proper regulation position has been described in the first embodiment, an exemplary solution to a problem caused when the side end regulating member is not placed in a proper regulation position will be described in the second embodiment. It is to be noted that like components are denoted by the same numerals as those used in the first embodiment and detailed description will not be repeated.

Figure 13A:
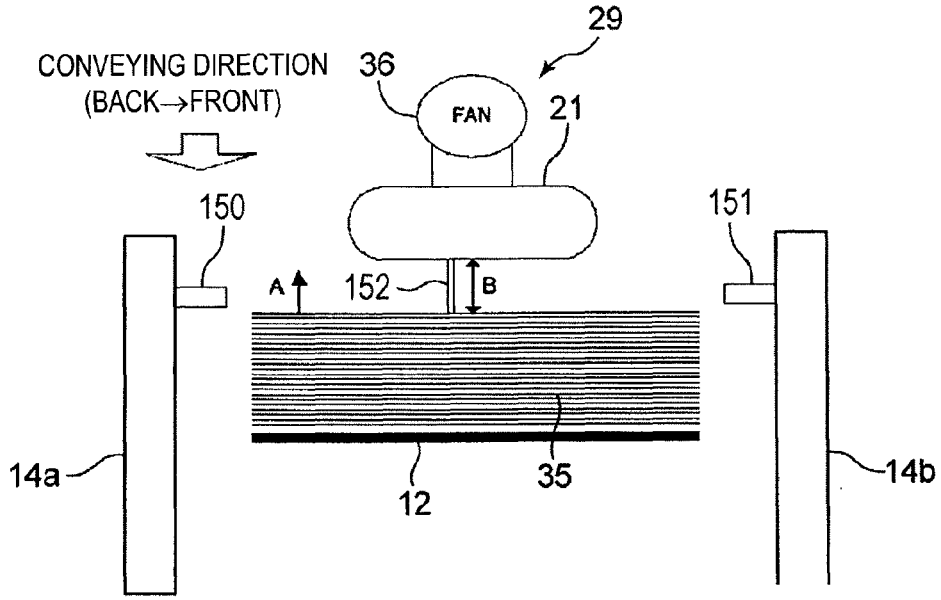
FIGS. 13A and 13B are views illustrating a case where a side end regulating plate is not properly set in the sheet feeding apparatus.
Figure 13B:
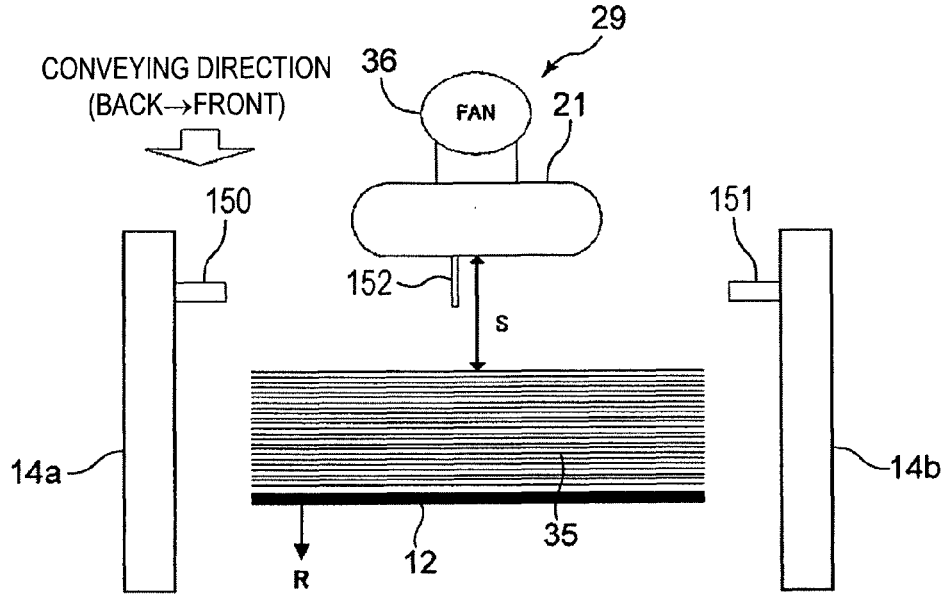

Each of the sheet storage portions 11 has the side end regulating member 14 at a front side (right side in FIG. 5) in a sheet conveying direction (lateral direction in FIG. 5). The side end regulating member 14 includes the first and second side end regulating members 14*a*, 14*b*, as illustrated in FIGS. 13A and 13B. The first side end regulating member 14*a* regulates a position at one side at a front side in the sheet conveying direction (front side in FIG. 5) of the sheets 35 stacked on the sheet tray 12 as a sheet stacking portion. The second side end regulating member 14*b* regulates a position at the other side at the front side in the sheet conveying direction (back side in FIG. 5) of the sheets 35 stacked on the sheet tray 12.

Figure 12A:
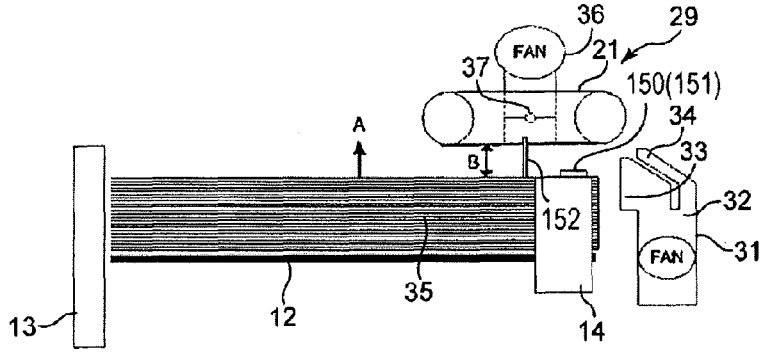
FIGS. 12A to 12D are schematic cross section views illustrating a state in a normal operation of a sheet feeding apparatus according to a second embodiment of the present invention.

As illustrated in FIGS. 12A and 13B, the first side end detecting sensor 150, which serves as the first side end detecting portion configured to detect one side at the front (front side in FIG. 5) of the topmost sheet 35 of the sheets 35 stacked on the sheet tray 12, is arranged on the first side end regulating member 14*a*. The second side end detecting sensor 151, which serves as the second side end detecting portion configured to detect the other side at the front (back side in FIG. 5) of the topmost sheet 35 of the sheets 35 stacked on the sheet tray 12, is arranged on the second side end regulating member 14*b*. The first side end detecting sensor 150 is arranged on the first side end regulating member 14*a*, at its side face upper side facing the sheet tray 12. The second side end detecting sensor 151 is arranged on the second side end regulating member 14*b*, at its side face upper side facing the sheet tray 12.

As illustrated in FIGS. 13A and 13B, as for the feeding unit 29 (see FIGS. 12A to 12D), the intermediate detecting sensor 152 as the intermediate detecting portion is arranged between the first side end detecting sensor 150 and the second side end detecting sensor 151. The intermediate detecting sensor 152 detects the front center portion (the intermediate portion in a direction from the front to the back in FIG. 5) of the topmost sheet 35 of the sheets 35 stacked on the sheet tray 12. It is to be noted that the first side end detecting sensor 150, the second side end detecting sensor 151, and the intermediate detecting sensor 152 generally include a reflection-type sensor or a light-blocking type sensor. However, a detection type is not limited thereto.

It is to be noted that a configuration of the CPU 30 as a controlling portion for controlling the sheet feeding apparatus 103 is the same as that in the first embodiment which has been described with reference to FIG. 7, so that detailed description will not be repeated.

When the storage case open/close detecting sensor 331 detects a state that the sheet storage portion (storage case) 11 has been closed, the ASIC 302 outputs a signal for driving the lifter motor 305 in a lifting direction. This signal becomes input to the driver 304 for controlling the lifter motor 305 and therefore, driving of the lifter motor 305 is controlled so as to lift the sheet tray 12. The sheet tray 12 is stopped in a position in which a distance between the suction conveyance belt 21 and the topmost sheet reaches B.

At this time, if the state is normal, both of the back end detecting sensor 150 and the front end detecting sensor 151 are supposed to detect a sheet upper-face. If the state is not normal, that is, when the first and second side end regulating members 14*a*, 14*b* are not properly set or when the sheets 35 stacked on the sheet tray 12 has a large downward curl at a side, the following situation would be contemplated. More specifically, the intermediate detecting sensor 152 detects the sheet face whereas at least one of the first side end detecting sensor 150 and the second side end detecting sensor 151 does not detect the sheet face. In such a case, while control is performed so that the alarm contents stored in the memory 303 are displayed on the display portion 321, the ASIC 302 may input a signal to the driver 304 of the lifter motor 305 so as to lower the sheet tray 12 by a predetermined amount.

Further, when the sheets 35 stacked on the sheet tray 12 have a large upward curl at a side, in some cases, the first side end paper detecting sensor 150 and the second side end detecting sensor 151 detect the sheet face while the intermediate detecting sensor 152 does not detect the sheet face. In such a case, while control is performed so that the alarm contents stored in the memory 303 are displayed on the display portion 321, the ASIC 302 may input a signal to the driver 304 of the lifter motor 305 so as to lower the sheet tray 12 by a predetermined amount. The sheet feeding apparatus 103 in the embodiment employs the purpose-built ASIC 302 to control various loads of, e.g., a motor in the sheet feeding apparatus 103. However, such a control is not limitative thereto and the CPU 301 may control loads directly without the ASIC 302.

Next, details on the sheet feeding apparatus 103 according to the embodiment will be described with reference to FIGS. 12A to 15B. It is to be noted that FIGS. 12A to 12D are views of an apparatus as viewed from a front side, and FIGS. 13A to 1B5 are views of an apparatus as viewed in the sheet conveying direction (from the entrance side). Next, a state in which the first and second side end regulating members 14*a*, 14*b* are properly set will be described with reference to FIGS. 12A to 12D.

In FIGS. 12A to 12D, when a user retracts the sheet storage portion (storage case) 11 after drawing it out to set the sheets therein, the sheet tray 12 starts to lift in a direction of arrow A in the drawing in response to activation of the lifter motor 305. The CPU 301 as a controlling portion stops the sheet tray 12 in a position in which a distance between the suction conveyance belt 21 and the topmost sheet reaches B, and waits for a feeing signal (FIG. 12A). This may be detected by the intermediate detecting sensor 152 or may be calculated based on a travel distance of the sheet tray 12. In a normal case, all of the first side end detecting sensor 150, the second side end detecting sensor 151, and the intermediate detecting sensor 152 detect the sheet upper-face.

Figure 12B:
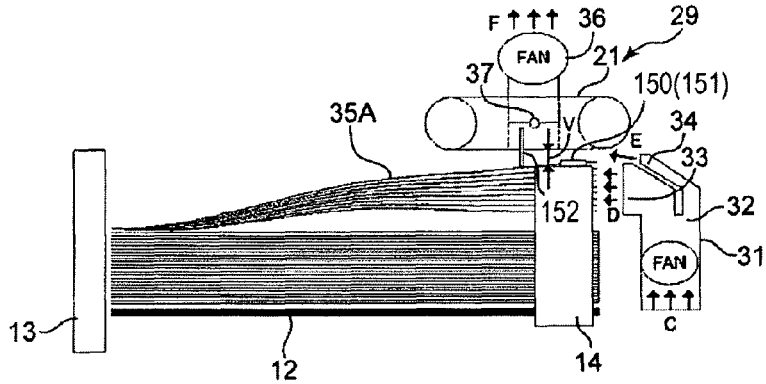

Upon detection of the feeding signal, the CPU 301 activates the loosening and separating air supply portion 31 which is disposed near the front end of the sheet tray 12, whereby air is suctioned in a direction of arrow C in the drawing (FIG. 12B). This air is passed through the separating duct 32 of the loosening and separating air supplying portion 31 and is then blown on the sheet bundle 35 through the loosening nozzle 33 and the separating nozzle 34 in directions of arrows D, E, respectively. Then, the top several sheets (35A) of the sheet bundle 35 are blown up as illustrated in FIG. 12B.

On the other hand, the CPU 301 activates the suction fan 36 configured to generate a negative pressure used to suction the sheets 35 onto the suction conveyance belt 21, whereby air is blown in a direction of arrow F in the drawing. At this time, the suction shutter 37 is still closed (FIG. 12B). In this case, both of the first and second side end detecting sensors 150, 151 detect the topmost sheet face and herein, a position of the sheet tray 12 is controlled so that a distance in a perpendicular direction (vertical direction) between the first side end detecting sensor 150 and the suction conveyance belt 21 is set to V.

Figure 12C:
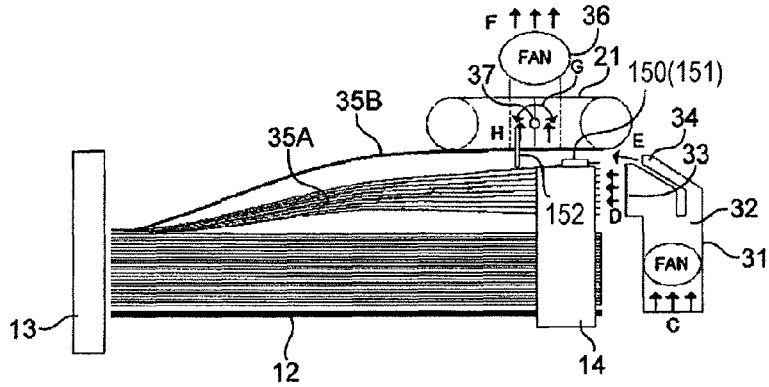
Figure 12D:
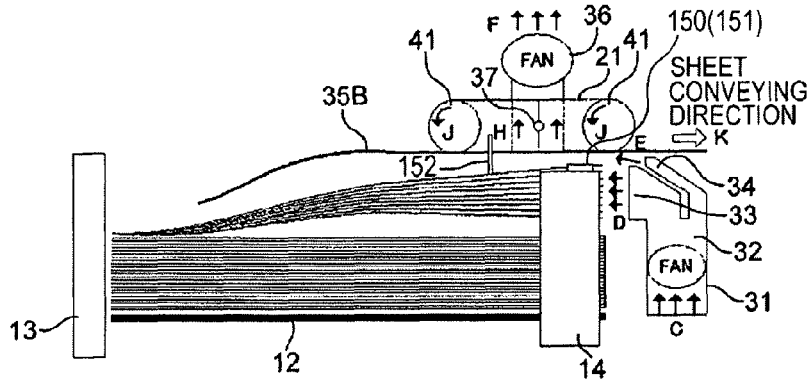

In FIG. 12C, the suction shutter 37 is rotated in a direction of arrow G when a predetermined time has elapsed from detection of the feeding signal and the blowing up of the sheet 35A becomes stable. Accordingly, suction force in a direction of arrow H in the drawing is generated from a number of suction holes (not illustrated), formed in the suction conveyance belt 21, so that the topmost sheet 35B is suctioned onto the suction conveyance belt 21. In FIG. 12D, the topmost sheet 35B is conveyed in a direction of arrow K by rotating the belt driving rollers 41 for supporting the suction conveyance belt 21 at its front and back ends, in a direction of arrow J in the drawing. The drawing roller 42 is then rotated so that the topmost sheet 35B is conveyed to the next conveyance path.

Next, a case where the first and second side end regulating members 14*a*, 14*b* are not set in a proper position will be described with reference to FIGS. 13A and 13B.

In FIGS. 13A and 13B, when the user retracts the sheet storage portion 11 in a predetermined position after drawing it out to set the sheets therein, the sheet tray 12 starts to lift in a direction of arrow A in the drawing in response to activation of the lifter motor 305. The sheet tray 12 is then stopped in a position in which a distance reaches B between the suction conveyance belt 21 and the topmost sheet (FIG. 13A).

In such a case, while the intermediate detecting sensor 152 detects the sheet face of the sheets 35, the first side end detecting sensor 150 and the second side end detecting sensor 151 do not detect the sheet face. In such a state, occurrence of the feeding failure such as described above is easily assumed even if the feeding of the sheet 35B is started, so that control is performed so as not to enable (so as to disable) start of the feeding operation. In such a case, the sheet tray 12 may be controlled to lower in a direction of arrow R in the drawing by a predetermined amount (herein, a distance between the suction conveyance belt 21 and the topmost sheet being set to S (S>B)) so as to facilitate setting of the side end regulating members 14*a*, 14*b* (FIG. 13B).

Next described with reference to FIGS. 3A and 3B is a case where the first and second side end regulating members 14*a*, 14*b* are properly set whereas neither of the first side end detecting sensor 150 and the second side end detecting sensor 151 detects the sheets. In such a case, as illustrated in FIG. 14A, it is contemplated that the sheets 35 stacked on the sheet tray 12 have a large upward curl at the side. In FIG. 14A, when the user retracts the sheet storage portion 11 in a predetermined position after drawing it out to set the sheets therein, the sheet tray 12 starts to lift in a direction of arrow A in the drawing in response to activation of the lifter motor 305. The sheet tray 12 is then stopped in a position in which a distance reaches B between the suction conveyance belt 21 and the topmost sheet (FIG. 14A).

In such a state, occurrence of the feeding failure such as described above is easily assumed even if the feeding of the sheet 35B is started, so that control is performed so as not to enable (so as to disable) start of the feeding operation. In such a case, the sheet tray 12 may be controlled to lower in a direction of arrow R in the drawing by a predetermined amount (herein, a distance between the suction conveyance belt 21 and the topmost sheet being set to S) (FIG. 14B) so that a state of the sheets 35 inside the sheet storage portion 11 can be easily checked.

FIGS. 13A and 14B illustrate a case where the intermediate detecting sensor 152 detects the sheet face (upper face) of the topmost sheet 35B whereas at least one of the first side end detecting sensor 150 and the second side end detecting sensor 151 does not detect the sheet face. In such a case, the CPU 301 performs control so as not to enable start of the feeding operation. At the same time, the CPU 301 performs control so as to display such an alarm as illustrated in FIGS. 8A and 8B on an operation screen of the printer 100. The contents of the alarm display in FIG. 8A are as to whether the first and second side end regulating members 14*a*, 14*b* are in a proper set state, whether the sheet bundle 35 stacked on the sheet tray 12 is set upside down, whether the sheets should be replaced, and the like. More specifically, the CPU 301 as a controlling portion performs control so as to issue an alarm having predetermined contents at a time of disabling start of the sheet feeding operation. Meanwhile, in a case of issuing the alarm with the predetermined contents, a configuration for giving an announcement is also applicable other than a configuration of the alarm display.

Further, when the user retracts the sheet storage portion 11 in a predetermined position, control is performed so that the sheet tray 12 starts to lift in a direction of arrow A in the drawing in response to activation of the lifter motor 305 and stops in a position in which a distance between the suction conveyance belt 21 and the topmost sheet reaches B so as to allow a judgment to be made as to whether a state is right or wrong. It is to be noted that the alarm display in FIG. 8A is one example and is not limitative as long as such a display is easily understandable to a user.

Figure 15A:
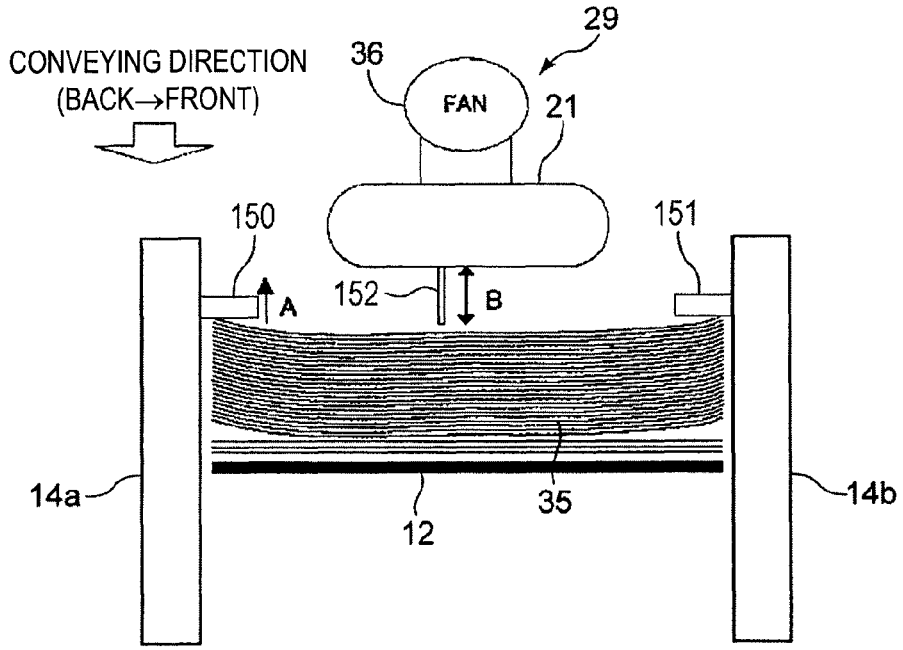
FIGS. 15A and 15B are views illustrating a case where a curl (upward curl) is large in the sheet feeding apparatus.

Next described with reference to FIGS. 4A and 4B is a case where the first and second side end regulating members 14*a*, 14*b* are properly set whereas either one of the first side end detecting sensor 150 and the second side end detecting sensor 151 does not detect the sheets. In such a case, as illustrated in FIG. 15A, it is contemplated that the sheets 35 stacked on the sheet tray 12 have a curl. In FIG. 15A, when the user retracts the sheet storage portion 11 in a predetermined position after drawing it out to set the sheets therein, the sheet tray 12 starts to lift in a direction of arrow A in the drawing in response to activation of the lifter motor 305. The sheet tray 12 is then stopped in a position in which a distance reaches B between the suction conveyance belt 21 and the topmost sheet (FIG. 15A).

In such a case, while the first side end detecting sensor 150 and the second side end detecting sensor 151 detect the sheet face, the intermediate side end detecting sensor 152 does not detect the sheet face. In such a state, occurrence of the feeding failure such as described above is easily assumed even if the feeding of the sheets is started, so that control is performed so as not to enable (so as to disable) start of the feeding operation. In such a case, the sheet tray 12 may be controlled to lower in a direction of arrow R in the drawing by a predetermined amount (herein, a distance between the suction conveyance belt 21 and the topmost sheet being set to S (S>B)) (FIG. 15B) so that a state of the sheets 35 inside the sheet storage portion 11 can be easily checked.

Figure 15B:
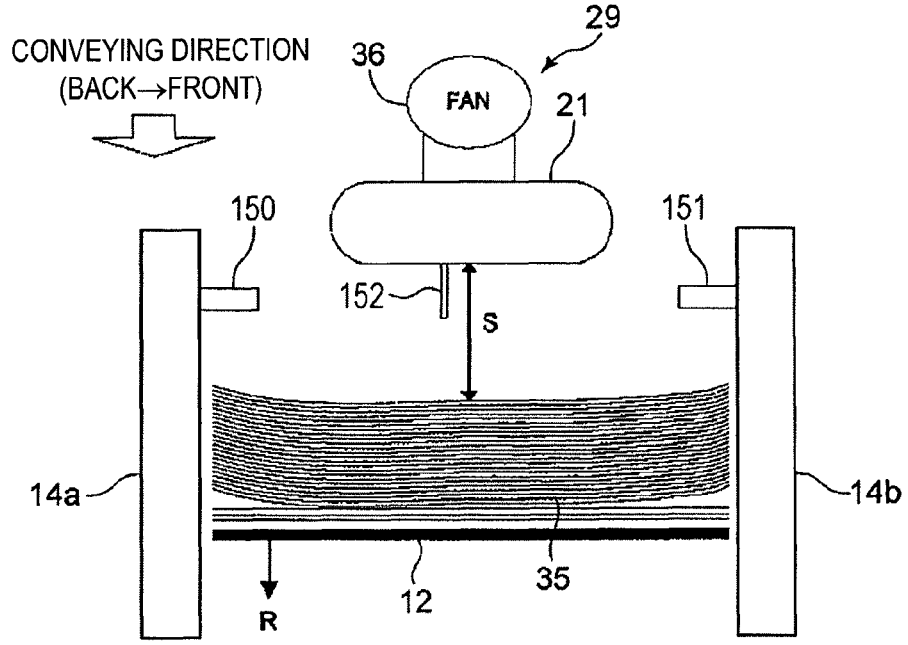

In FIGS. 15A and 15B, in a case where the first side end detecting sensor 150 and the second side end detecting sensor 151 detect the whereas the intermediate detecting sensor 152 does not detect the sheet face of the sheets 35, the CPU 301 performs control so as not to enable start of the feeding operation. At the same time, the CPU 301 also performs control to display an alarm such as illustrated in FIG. 8B, on the operation screen (display portion 321 in FIGS. 6A and 6B) of the printer 100. The sheet storage portion 11 is retracted in the predetermined position after the sheets 35 on the sheet tray 12 has been replaced or turned upside down, the sheet tray 12 starts to lift in a direction of arrow A in the drawing by means of the lifter motor 305. Further, the sheet tray 12 is stopped in a position in which a distance between the suction conveyance belt 21 and the topmost sheet reaches B, and control is performed to determine as to whether a state is right or wrong. It is to be noted that the alarm display in FIG. 8B is one example and is not limitative as long as such a display is easily understandable to a user.

Further, a curl state of the sheets 35 stacked on the sheet tray 12 may gradually get worse while the sheets 35 are left on the sheet tray 12 for a long time. Therefore, the aforementioned control may be performed, even during standby, by always monitoring a state of the first side end detecting sensor 150 and the second side end detecting sensor 151.

Figure 17A:
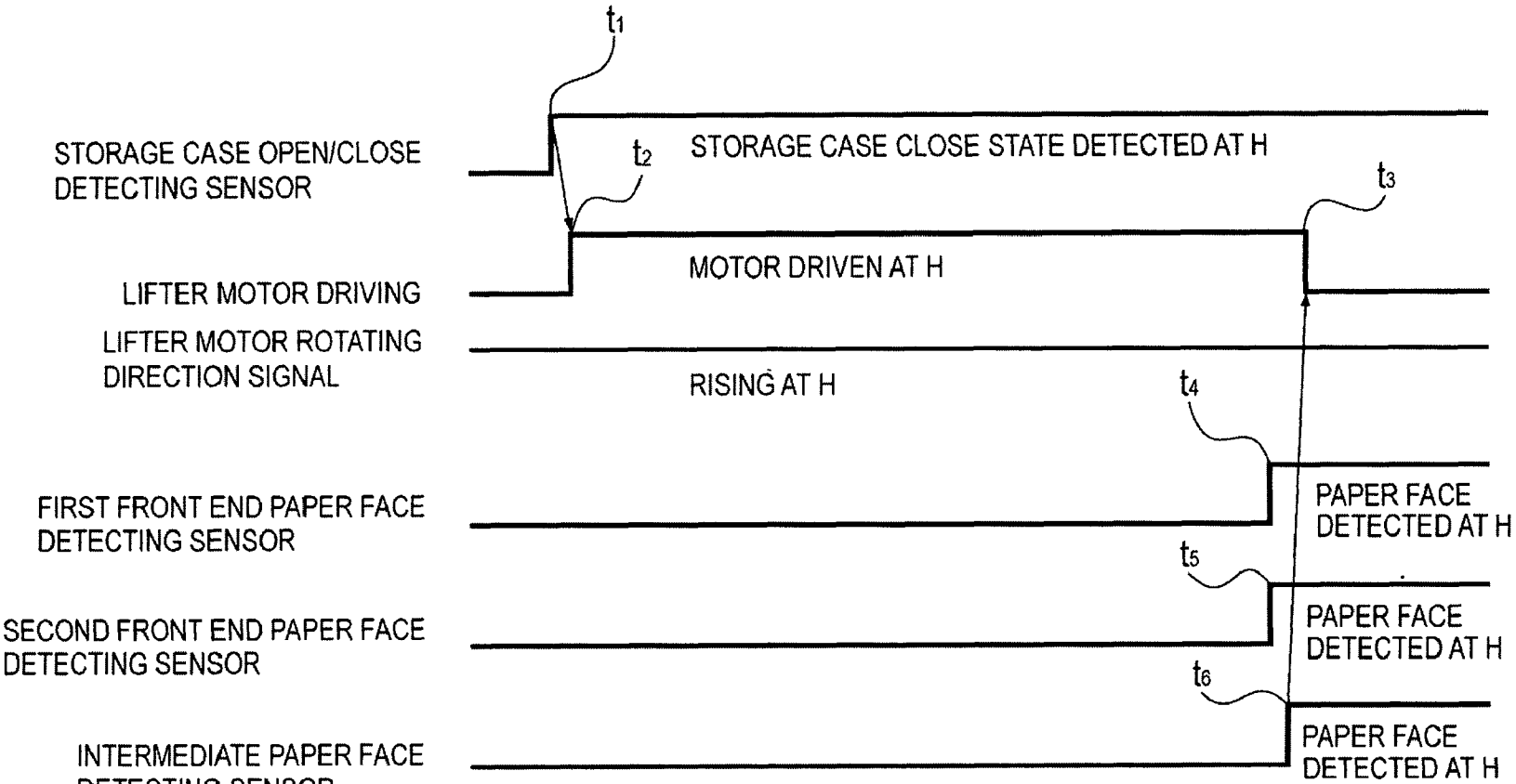
FIGS. 17A to 17C are timing charts illustrating a signal at a time of a normal operation according to the second embodiment.

Herein, described with reference to a timing chart of FIG. 17A is a timing of signals in a case where the first and second side end regulating members 14*a*, 14*b* are properly set and the sheets 35 stacked on the sheet tray 12 are free from a curl.

More specifically, when the storage case open/close detecting sensor 331 detects a state that the sheet storage portion 11 has been closed ($t_1$), control is performed so as to lift ($t_2$) and stop ($t_3$) the sheet tray 12 in a position (predetermined position) in which a distance between the topmost sheet and the suction conveyance belt 21 reaches a predetermined value. This may be detected by the intermediate detecting sensor 152 or may be calculated based on a travel distance of the sheet tray 12. At this time, all of the first side end detecting sensor 150, the second side end detecting sensor 151, and the intermediate detecting sensor 152 detect the sheet upper-face ($t_4$, $t_5$, $t_6$). In this case, control is performed so as to enable start of the subsequent sheet feeding operation carried out by the feeding unit 29. The first side end detecting sensor 150 and the intermediate detecting sensor 152 may be arranged so as to have a difference in a position (in level) for detecting the sheet face or may be arranged in the same position (in level).

Figure 17B:
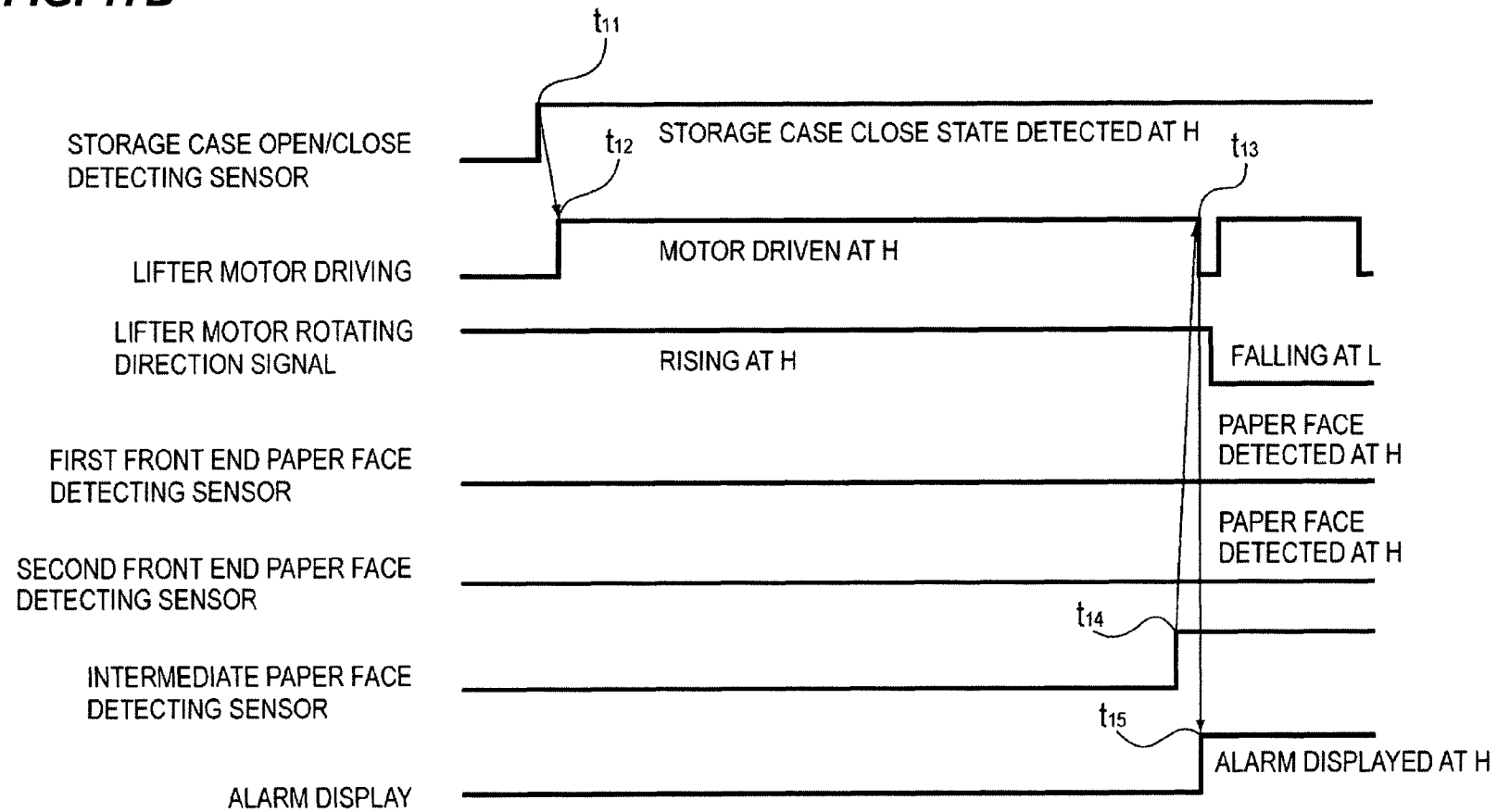

Next, described with reference to a timing chart of FIG. 17B is a timing of signals in a case where the first and second side end regulating members 14*a*, 14*b* are not properly set but the sheets 35 stacked on the sheet tray 12 have a large downward curl.

More specifically, when the storage case open/close detecting sensor 331 detects a state that the sheet storage portion 11 has been closed ($t_{11}$), control is performed so as to lift the sheet tray 12 by driving of the lifter motor 305 ($t_{12}$). The sheet tray 12 is then stopped when a distance between the topmost sheet and the suction conveyance belt 21 reaches a predetermined value ($t_{13}$). At this time, while the intermediate detecting sensor 152 detects the ($t_{14}$), neither of the first and second side end detecting sensors 150, 151 detects the upper-face of the sheets. In such a case, the CPU 301 performs control so as to display an alarm illustrated in FIG. 8A when stopping a driving operation for lifting of the lifter motor 305 ($t_{15}$). Further, the lifter motor 305 may be controlled to execute a driving operation for lowering when a predetermined time has elapsed after stop of the lifting operation of the lifter motor 305.

Figure 17C:
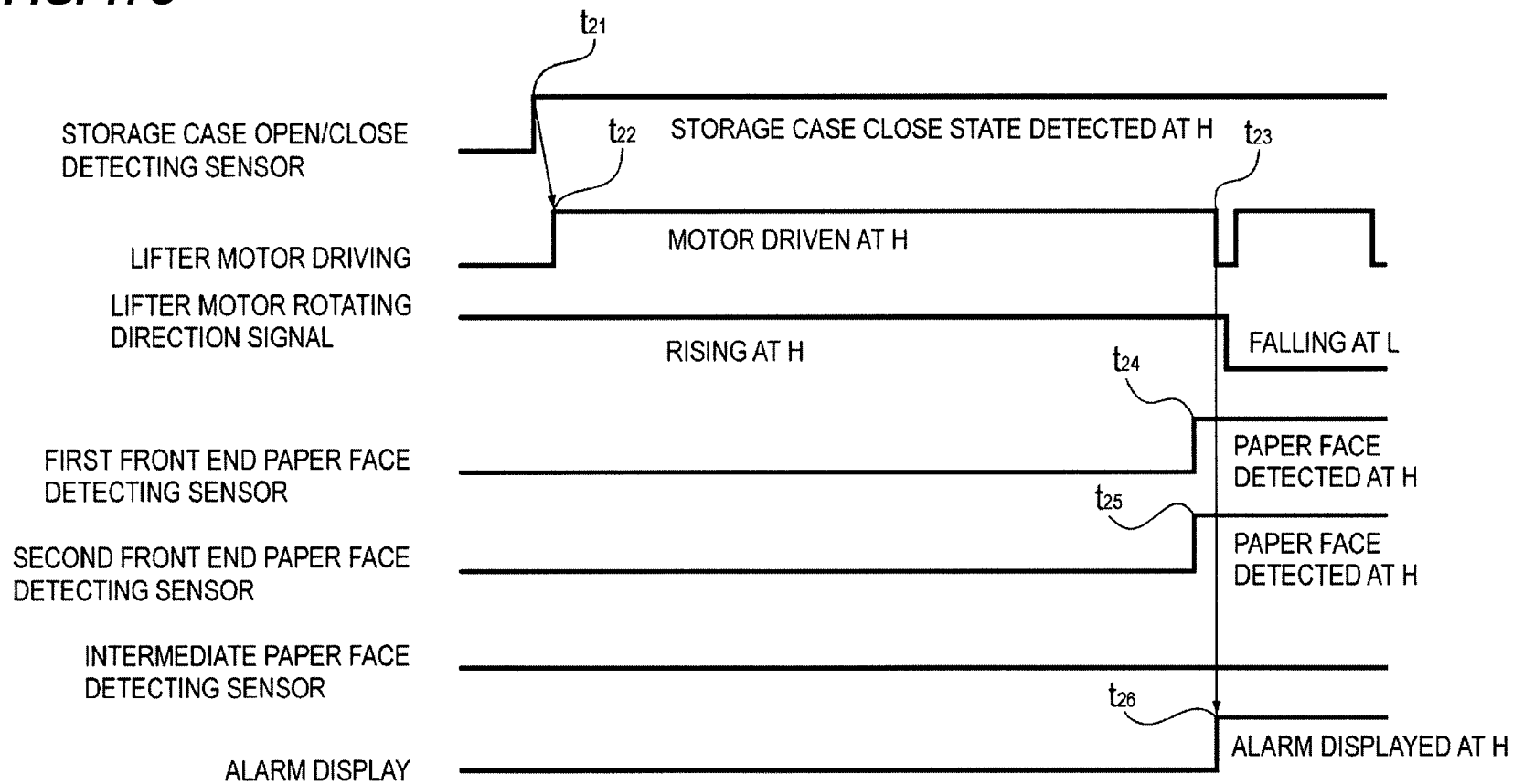
Figure 18A:
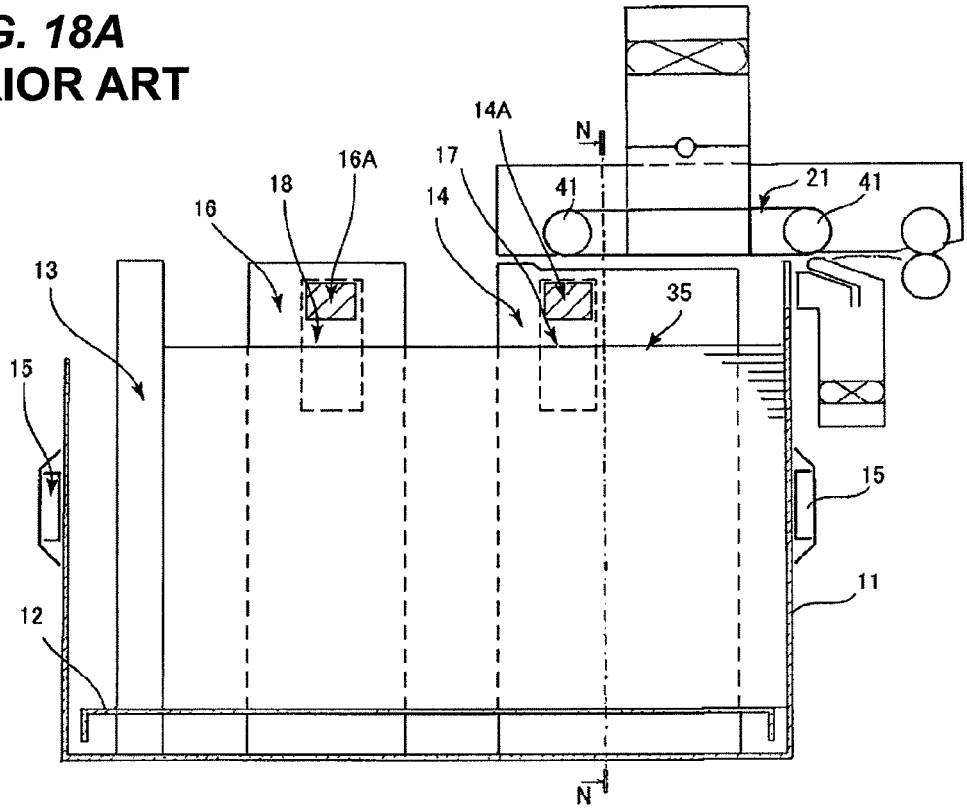
FIG. 18A PRIOR ART
FIGS. 18A and 18B are views illustrating a conventional sheet feeding apparatus.
Figure 18B:
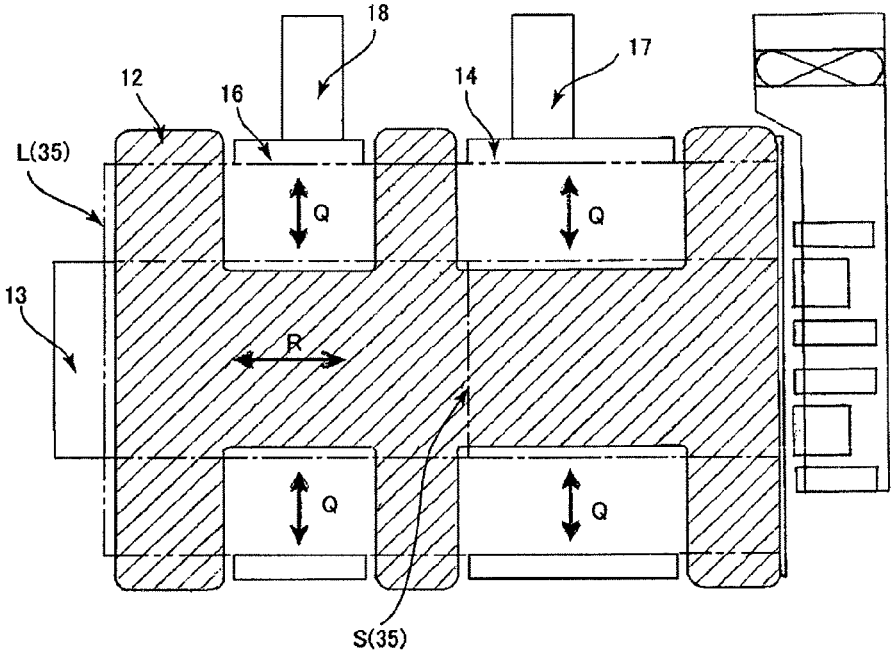
FIG. 18B PRIOR ART
Figure 19A:
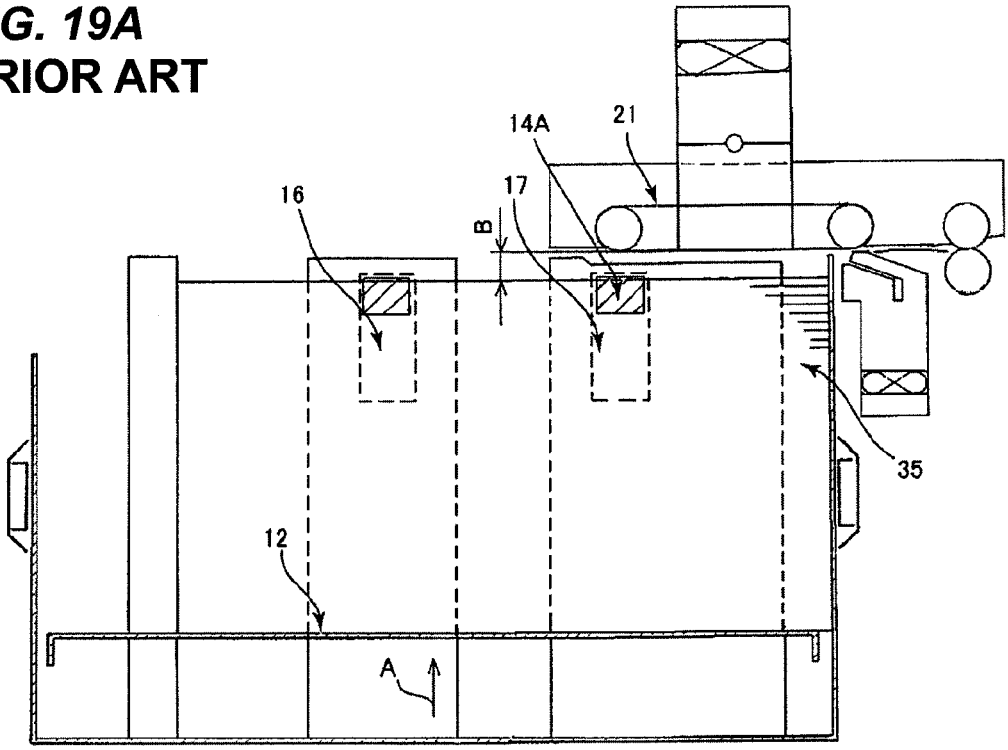
FIG. 19A PRIOR ART
FIGS. 19A and 19B are views illustrating an operation of the sheet feeding apparatus.
Figure 19B:
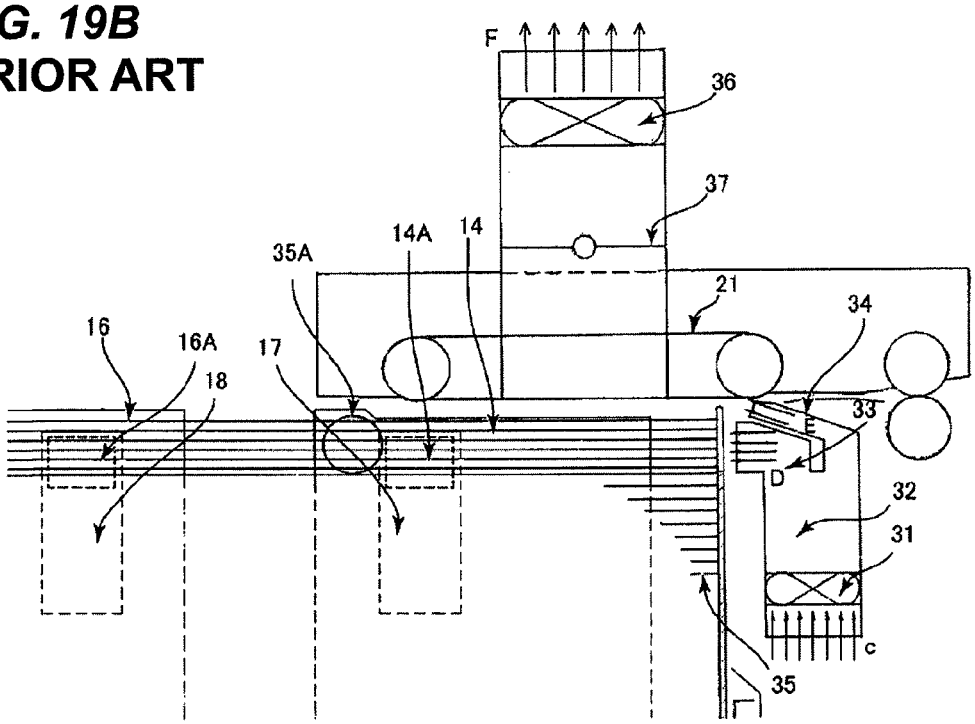
FIG. 19B PRIOR ART
Figure 20A:
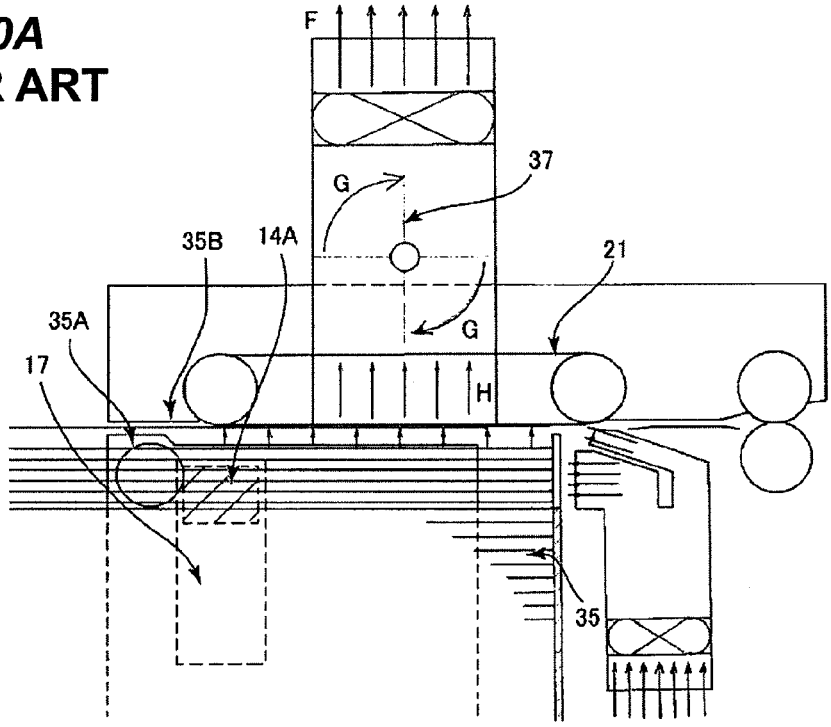
FIG. 20A PRIOR ART
FIGS. 20A and 20B are views illustrating an operation of the conventional sheet feeding apparatus.
Figure 20B:
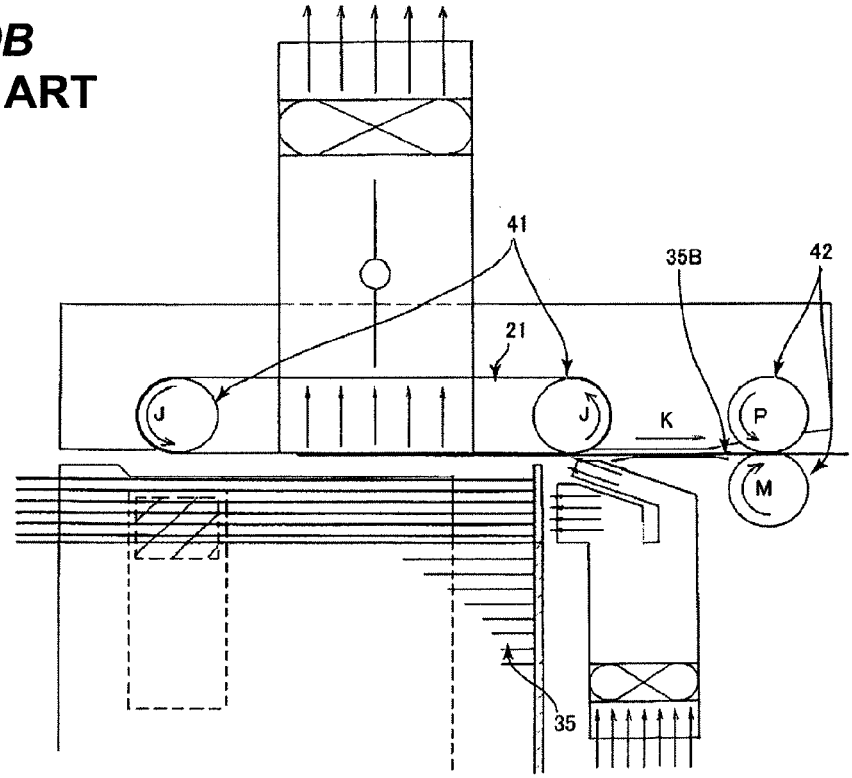
FIG. 20B PRIOR ART
Figure 21A:
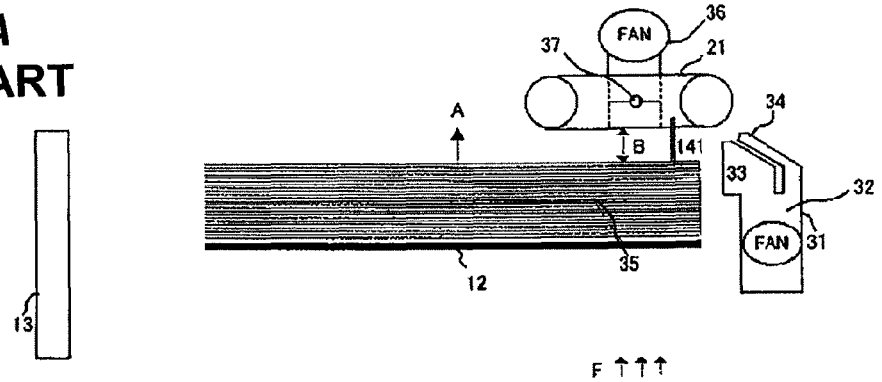
FIG. 21A PRIOR ART
FIGS. 21A to 21D are schematic side views illustrating a problem caused in a case where a back end regulating member is not properly set in the conventional sheet feeding apparatus.
Figure 21B:
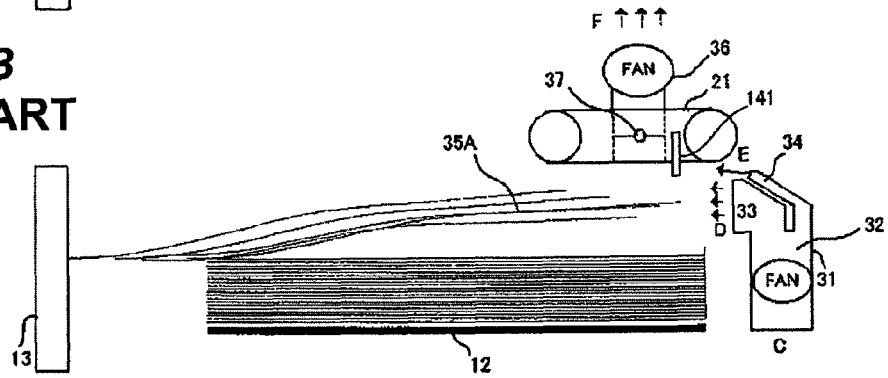
FIG. 21B PRIOR ART
Figure 21C:
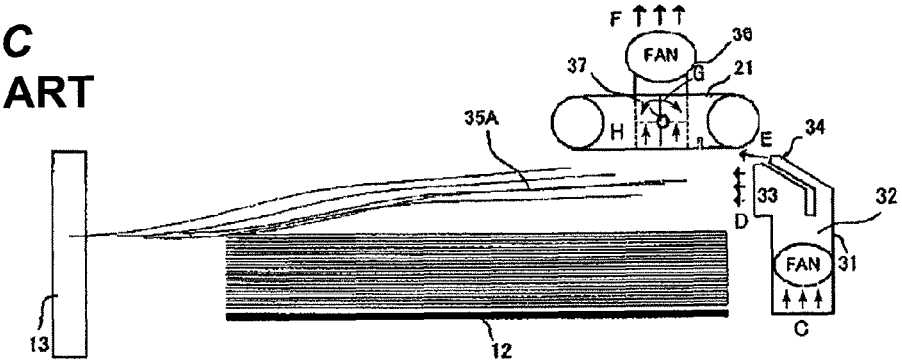
FIG. 21C PRIOR ART
Figure 21D:
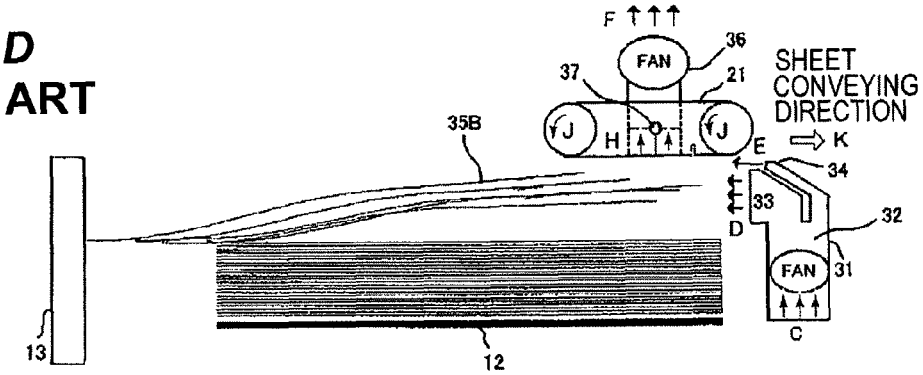
FIG. 21D PRIOR ART
Figure 22A:
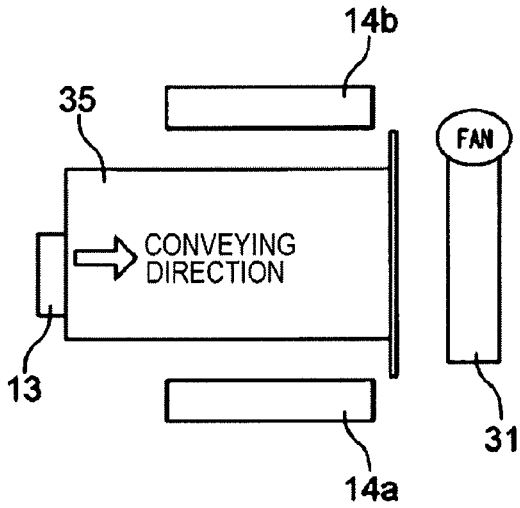
FIG. 22A PRIOR ART
FIGS. 22A to 22C are schematic plan views illustrating a problem caused in a case where a side end regulating member is not properly set in the conventional sheet feeding apparatus.
Figure 22B:
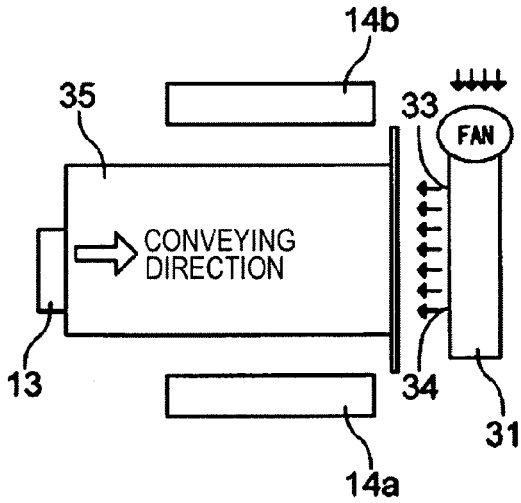
FIG. 22B PRIOR ART
Figure 22C:
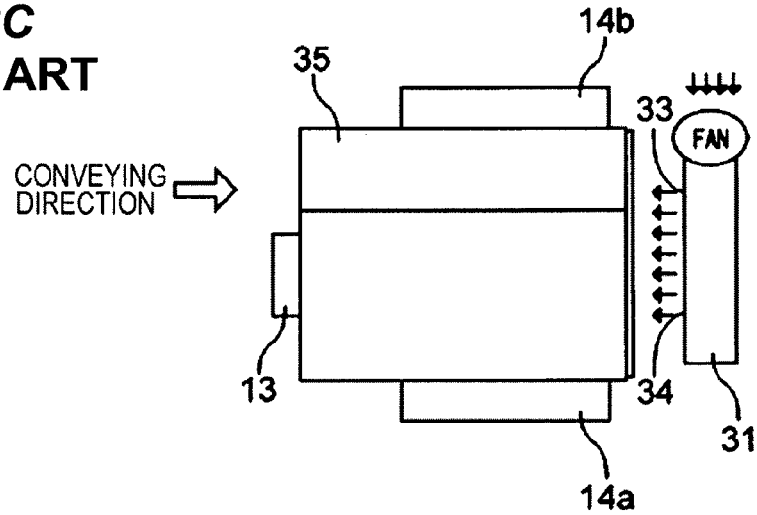
FIG. 22C PRIOR ART

Next, described with reference to a timing chart of FIG. 17C is a timing of signals in a case where the first and second side end regulating members 14*a*, 14*b* are properly set while the sheets 35 stacked on the sheet tray 12 have a large downward curl.

When the storage case open/close detecting sensor 331 detects a state that the sheet storage portion 11 has been closed ($t_{21}$), control is performed so as to lift the sheet tray 12 by driving of the lifter motor 305 ($t_{22}$). The sheet tray 12 is then stopped when a distance between the topmost sheet and the suction conveyance belt 21 reaches a predetermined value ($t_{23}$). At this time, while the first side end detecting sensor 150 and the second side end detecting sensor 151 detect the upper-face ($t_{24}$, $t_{25}$), the intermediate detecting sensor 152 does not detect the upper-face of the sheets. In such a case, the CPU 301 performs control so as to display an alarm illustrated in FIG. 8A when stopping a driving operation for lifting of the lifter motor 305 ($t_{26}$). Further, the lifter motor 305 may be controlled to execute a driving operation for lowering when a predetermined time has elapsed after stop of the lifting operation of the lifter motor 305.

Figure 16:
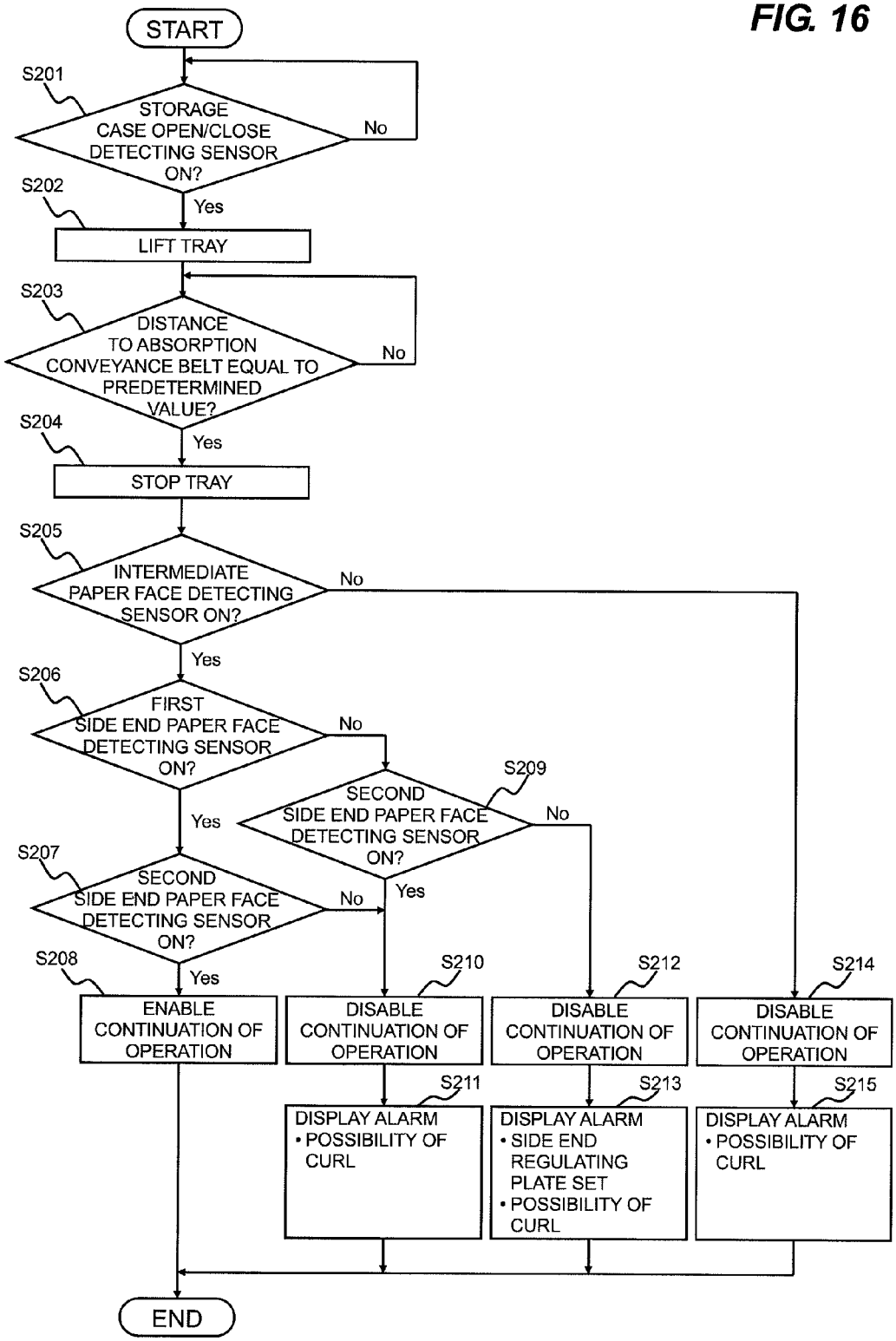
FIG. 16 is a flowchart illustrating an effect of the second embodiment.

Next, an advantageous effect of the embodiment will be described with reference to a flowchart in FIG. 16. The CPU 301 controls this flowchart.

That is, when the storage case open/close detecting sensor 331 detects a state that the sheet storage portion (storage case) 11 has been closed (S201), the CPU 301 performs control so as to lift the sheet tray (tray) 12 by controlling the lifter motor 305 (S202). If a close state of the sheet storage portion 11 is not detected at step S201, the operation stands and waits until when the sheet storage portion 11 is closed.

The lifter motor 305 is controlled so as to lift the sheet tray 12, and a determination is made at step S203 as to whether a distance between the suction conveyance belt 21 and the topmost sheet reaches a predetermined value (that is, a predetermined position). As a result, if the distance has reached the predetermined value, driving of the lifter motor 305 is stopped to stop the sheet tray 12 (S204). At this time, the intermediate end detecting sensor 152 is turned on and detects the sheet face at step S205, the processing shifts to step S206.

If the side end detecting sensor 150 is also turned on at step S206, the processing shifts to step S207. If the second side end detecting sensor 151 is also turned on at step S207, the CPU 301 performs control to enable continuation of the subsequent operation (start of the sheet feeding operation) (S208).

On the other hand, if the intermediate end detecting sensor 152 does not detect the upper-face of the sheets at step S205, the CPU 301 performs control so as not to enable continuation of the subsequent operation (S214). Further, the processing shifts to step S215 to perform control so as to display an alarm illustrated in FIG. 8B. Although it is not illustrated, the sheet tray 12 may be controlled to lower by a predetermined amount in association with step S215.

If the first side end detecting sensor 150 does not detect the sheet face at step S206, the processing shifts to step S209. If the second side end detecting section 151 does not detect the upper-face as well, control is performed so as not to enable continuation of the subsequent operation (S212). Further, the operation shifts to step S213, in which the CPU 301 performs control to display an alarm illustrated in FIG. 8A. Although it is not illustrated, the sheet tray 12 may be controlled to lower by a predetermined amount in association with step S213.

In a case where the second side end detecting sensor 151 does not detect the upper-face of the sheets at step S207 and where the second side end detecting sensor 151 detects the upper-face of the sheets at step S209, the operation shifts to step S210 at which control is performed so as not to enable continuation of the subsequent operation. Further, the operation shifts to step S211 to perform control so as to display an alarm illustrated in FIG. 8B. Although it is not illustrated, the sheet tray 12 may be controlled to lower by a predetermined amount in association with step S211. While a determination is made at step S203 as to whether a distance between the topmost sheet and the suction conveyance belt 21 reaches a predetermined value, such a determination may be made based on whether the sensor (not illustrated) is turned on.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-004886, filed Jan. 13, 2010, which is hereby incorporated by reference herein in its entirety.

What is claimed is:

1. A sheet feeding apparatus comprising:

a sheet stacking portion capable of lifting and lowering, on which sheets are stacked;

an air blowing portion which blows air on the sheets stacked on the sheet stacking portion to loosen the sheets;

a suction conveyance portion which suctions and conveys the sheets loosened by the air blowing portion;

a driving portion which drives the sheet stacking portion to lift and lower with respect to the suction conveyance portion;

a back end regulating member which regulates a position of a back end in a conveying direction of the sheets stacked on the sheet stacking portion;

a back end detecting portion which is arranged on the back end regulating member and detects a back end side in the conveying direction of a topmost sheet of the sheets stacked on the sheet stacking portion;

a front end detecting portion which detects a front end side in the conveying direction of the topmost sheet of the sheets stacked on the sheet stacking portion; and a controlling portion which performs control to disable start of a sheet feeding operation of the suction conveyance portion in a case where the back end detecting portion and the front end detecting portion do not detect the sheets when the driving portion is controlled so that the sheet stacking portion lifts toward the suction conveyance portion and stops in a predetermined position.

2. The sheet conveying apparatus according to claim 1, wherein the controlling portion performs control so as to issue an alarm having a predetermined content at a time of disabling the start of the sheet feeding operation.

3. The sheet feeding apparatus according to claim 1, further comprising an intermediate detecting portion which is disposed between the back end detecting portion and the front end detecting portion and detects the topmost sheet of the sheets stacked on the sheet stacking portion, wherein the controlling portion stops a lifting operation of the sheet stacking portion under control of the driving portion at a time that the intermediate detecting portion detects the topmost sheet of the sheets stacked on the sheet stacking portion.

4. A sheet feeding apparatus comprising:

a sheet stacking portion capable of lifting and lowering, on which sheets are stacked;

an air blowing portion which blows air on a side face of the sheets stacked on the sheet stacking portion to loosen the sheets;

a suction conveyance portion which suctions and conveys the sheets loosened by the air blowing portion;

a driving portion which drives the sheet stacking portion to lift and lower with respect to the suction conveyance portion;

a first side end regulating member which regulates a position of one side end at a front side in a sheet conveying direction of the sheets stacked on the sheet stacking portion;

a second side end regulating member which regulates a position of the other side end at the front side in the sheet conveying direction of the sheets stacked on the sheet stacking portion;

a first side end detecting portion which is disposed on the first side end regulating member and detects one side end at a front side of a topmost sheet of the sheets stacked on the sheet stacking portion;

a second side end detecting portion which is disposed on the second side end regulating member and detects the other side end at the front side of the topmost sheet of the sheets stacked on the sheet stacking portion;

an intermediate detecting portion which is disposed between the first side end detecting portion and the second side end detecting portion and detects a center portion at the front side of the topmost sheet of the sheets stacked on the sheet stacking portion; and a controlling portion which performs control so as to disable start of a sheet feeding operation of the suction conveyance portion in a case where the first side end detecting portion, the second side end detecting portion, and the intermediate detecting portion do not detect the sheets when the driving portion is controlled so that the sheet stacking portion lifts toward the suction conveyance portion and stops in a predetermined position.

5. The sheet feeding apparatus according to claim 4, wherein the controlling portion performs control so as to issue an alarm having a predetermined content at a time of disabling the start of the sheet feeding operation.

6. The sheet feeding apparatus according to claim 4, wherein the controlling portion stops a lifting operation of the sheet stacking portion under control of the driving portion at a time that the intermediate detecting portion detects the topmost sheet of the sheets stacked on the sheet stacking portion.

7. An image forming apparatus having an image forming portion which forms an image on a sheet fed by a sheet feeding apparatus, the sheet feeding apparatus comprising:

a sheet stacking portion capable of lifting and lowering, on which sheets are stacked;

an air blowing portion which blows air on a side face of the sheets stacked on the sheet stacking portion to loosen the sheets;

a suction conveyance portion which suctions and conveys the sheets loosened by the air blowing portion;

a driving portion which drives the sheet stacking portion to lift and lower with respect to the suction conveyance portion;

a back end regulating member which regulates a position of a back end in a conveying direction of the sheets stacked on the sheet stacking portion;

a back end detecting portion which is arranged on the back end regulating member and detects a back end side in the conveying direction of a topmost sheet of the sheets stacked on the sheet stacking portion;

a front end detecting portion which detects a front end side in the conveying direction of the topmost sheet of the sheets stacked on the sheet stacking portion; and a controlling portion which performs control to disable start of a sheet feeding operation of the suction conveyance portion in a case where the back end detecting portion and the front end detecting portion do not detect the sheets when the driving portion is controlled so that the sheet stacking portion lifts toward the suction conveyance portion and stops in a predetermined position.

8. The image forming apparatus according to claim 7, wherein the controlling portion performs control so as to issue an alarm having a predetermined content at a time of disabling the start of the sheet feeding operation.

9. The image forming apparatus according to claim 7, further comprising an intermediate detecting portion which is disposed between the back end detecting portion and the front end detecting portion and detects the topmost sheet of the sheets stacked on the sheet stacking portion, wherein the controlling portion stops a lifting operation of the sheet stacking portion under control of the driving portion at a time that the intermediate detecting portion detects the topmost sheet of the sheets stacked on the sheet stacking portion.

10. An image forming apparatus having an image forming portion which forms an image on a sheet fed by a sheet feeding apparatus, the sheet feeding apparatus comprising:

a sheet stacking portion capable of lifting and lowering, on which sheets are stacked;

an air blowing portion which blows air on a side face of the sheets stacked on the sheet stacking portion to loosen the sheets;

a suction conveyance portion which suctions and conveys the sheets loosened by the air blowing portion;

a driving portion which drives the sheet stacking portion to lift and lower with respect to the suction conveyance portion;

a first side end regulating member which regulates a position of one side end at a front side in a sheet conveying direction of the sheets stacked on the sheet stacking portion;

a second side end regulating member which regulates a position of the other side end at the front side in the sheet conveying direction of the sheets stacked on the sheet stacking portion;

a first side end detecting portion which is disposed on the first side end regulating member and detects one side end at a front side of a topmost sheet of the sheets stacked on the sheet stacking portion;

a second side end detecting portion which is disposed on the second side end regulating member and detects the other side end at the front side of the topmost sheet of the sheets stacked on the sheet stacking portion;

an intermediate detecting portion which is disposed between the first side end detecting portion and the second side end detecting portion and detects a center portion at the front side of the topmost sheet of the sheets stacked on the sheet stacking portion; and a controlling portion which performs control so as to disable start of a sheet feeding operation of the suction conveyance portion in a case where the first side end detecting portion, the second side end detecting portion, and the intermediate detecting portion do not detect the sheets when the driving portion is controlled so that the sheet stacking portion lifts toward the suction conveyance portion and stops in a predetermined position.

11. The image forming apparatus according to claim 10, wherein the controlling portion performs control so as to issue an alarm having a predetermined content at a time of disabling the start of the sheet feeding operation according to claim 4.

12. The image forming apparatus according to claim 10, wherein the controlling portion stops a lifting operation of the sheet stacking portion under control of the driving portion at a time that the intermediate detecting portion detects the topmost sheet of the sheets stacked on the sheet stacking portion.

* * * * *